US007686194B2

(12) United States Patent
Kasting

(10) Patent No.: US 7,686,194 B2
(45) Date of Patent: Mar. 30, 2010

(54) CLOSED LOOP FLUID DISPENSING SYSTEM

(75) Inventor: Thomas P. Kasting, Fort Wayne, IN (US)

(73) Assignee: Rieke Corporation, Auburn, IN (US)

( * ) Notice: Subject to any disclaimer, the term of this patent is extended or adjusted under 35 U.S.C. 154(b) by 857 days.

(21) Appl. No.: 11/461,876

(22) Filed: Aug. 2, 2006

(65) Prior Publication Data

US 2006/0283896 A1 Dec. 21, 2006

Related U.S. Application Data

(63) Continuation-in-part of application No. 10/654,100, filed on Sep. 3, 2003, now Pat. No. 7,121,437.

(51) Int. Cl.
*B65D 47/00* (2006.01)

(52) U.S. Cl. ..... 222/549; 222/153.09; 215/330

(58) Field of Classification Search ..... 222/549, 222/142.7, 144, 153.09, 153.1; 215/216, 215/227, 330–335; 220/254.1, 254.2, 254.8, 220/254.9

See application file for complete search history.

(56) References Cited

U.S. PATENT DOCUMENTS

| | | | | |
|---|---|---|---|---|
| 3,850,330 | A | 11/1974 | Koontz et al. | |
| 3,901,410 | A | 8/1975 | Schultz | |
| 3,945,772 | A | 3/1976 | Van de Moortele | |
| 3,991,908 | A | 11/1976 | Thomas et al. | |
| 4,065,037 | A * | 12/1977 | Haller | 222/153.02 |
| 4,084,716 | A | 4/1978 | Bogert | |
| 4,749,103 | A * | 6/1988 | Barriac | 222/48 |
| 4,832,237 | A | 5/1989 | Hurford, Jr. | |
| 4,862,918 | A | 9/1989 | Schroeder et al. | |
| 5,040,702 | A | 8/1991 | Knickerbocker et al. | |

(Continued)

FOREIGN PATENT DOCUMENTS

| | | |
|---|---|---|
| CH | 414378 A1 | 5/1966 |

(Continued)

OTHER PUBLICATIONS

European Patent Application 07252919.1 Partial Search Report mailed Nov. 30, 2007.

(Continued)

*Primary Examiner*—Lien T Ngo
(74) *Attorney, Agent, or Firm*—Woodard, Emhardt, Moriarty, McNett & Henry LLP

(57) ABSTRACT

A fluid dispensing system includes a closure assembly. The closure assembly is configured to enclose a container opening. The closure assembly has a fluid supply tube with an opening and a shut-off valve threadedly coupled to the supply tube. The shut-off valve has a valve member configured to close the opening in the supply tube upon rotating the shut-off valve in a first direction and to open the opening in the supply tube upon rotating the shut-off valve in a second direction. A cap assembly is coupled to the closure assembly. The cap assembly has a connector member with a fluid passage fluidly coupled to the supply tube. The cap assembly is coupled to the shut-off valve to rotate the shut-off valve in the first direction and the second direction. The configuration of the system eliminates the need for spring-based valves.

19 Claims, 21 Drawing Sheets

U.S. PATENT DOCUMENTS

| | | | | |
|---|---|---|---|---|
| 5,072,756 | A | 12/1991 | Carr et al. | |
| 5,092,477 | A * | 3/1992 | Johnson et al. | 215/230 |
| 5,169,033 | A | 12/1992 | Shay | |
| 5,636,769 | A | 6/1997 | Willingham et al. | |
| 5,676,270 | A | 10/1997 | Roberts | |
| 5,743,444 | A * | 4/1998 | Beck et al. | 222/521 |
| 5,890,517 | A | 4/1999 | Laible | |
| 5,938,087 | A | 8/1999 | Randall | |
| 5,960,840 | A | 10/1999 | Simmel et al. | |
| 5,988,456 | A | 11/1999 | Laible | |
| 6,050,459 | A | 4/2000 | Johnson et al. | |
| 6,117,319 | A | 9/2000 | Cranshaw | |
| 6,135,329 | A | 10/2000 | Stoneberg et al. | |
| 6,142,345 | A | 11/2000 | Laible | |
| 6,170,543 | B1 | 1/2001 | Simmel et al. | |
| 6,299,027 | B1 | 10/2001 | Berge et al. | |
| 6,341,721 | B1 | 1/2002 | Herald et al. | |
| 6,913,168 | B2 | 7/2005 | Lawson et al. | |
| 7,111,746 | B2 * | 9/2006 | Miceli et al. | 215/219 |
| 2002/0179157 | A1 | 12/2002 | Rokkjaer | |
| 2003/0150887 | A1 | 8/2003 | Laible | |

FOREIGN PATENT DOCUMENTS

| | | | |
|---|---|---|---|
| EP | 1 512 638 | A | 3/2005 |
| FR | 2 589 829 | | 5/1987 |
| FR | 2 589 829 | A2 | 5/1987 |
| GB | 2 346 365 | A | 9/2000 |

OTHER PUBLICATIONS

European Patent Application 07 25 2919 Search Report mailed Apr. 1, 2008.

* cited by examiner

CLOSED LOOP FLUID DISPENSING SYSTEM

REFERENCE TO RELATED APPLICATIONS

This application is a continuation-in-part (CIP) of U.S. patent application Ser. No. 10/654,100, filed Sep. 3, 2003, now U.S. Pat. No. 7,121,437 which is hereby incorporated by reference in its entirety.

BACKGROUND

The present invention generally relates to product dispensing systems and more specifically, but not exclusively, concerns product dispensing systems, which provide closed loop transfer of chemical concentrates from a source container to downstream mixing/blending devices.

Within the janitorial and sanitation industries, chemicals used to support various cleaning activities have tended to migrate toward becoming more concentrated. This reduces shipping costs since the water required for proper dilution is no longer being shipped as part of the product. On-hand inventory is reduced since the concentrated chemicals, when properly diluted, can produce many gallons of appropriate strength cleaning solutions. Concentrated chemicals can also be diluted at different rates on site to satisfy unique cleaning requirements, an option made much more difficult with premixed solutions.

The dilution of chemical concentrates used for cleaning is typically accomplished with water. A class of devices commonly referred to as proportioners handles controlled mixing. These proportioners are usually connected to a water source and feature a mechanism for controlling the flow of water. When the water flow has been initiated, the chemical concentrate is introduced into the water stream at a predetermined rate by the proportioner. The blended liquid is then directed into another container such as a sink, bucket, or bottle.

Typically, to transport the concentrates to the proportioner, a small flexible tube runs from a fitting on the proportioner to the concentrate container. These containers, commonly one-gallon in size although other sizes are used, are placed on the floor, on a shelf or rack, or in a cabinet in close proximity to the proportioner. In many cases the top of the container is simply discarded and the tube placed into the open neck finish. The end of the tube can feature a small weight to prevent the tubing from floating on the liquid's surface.

These open concentrate bottles will likely be found in a variety of environments that have the potential of exposing the container to abuse such as tipping, falling, and impact. Any of these events have the potential of spilling or splashing the concentrate with subsequent physical damage to the surroundings, creation of hazardous material (HAZMAT) situations, and placing personnel at risk.

A number of attempts have been made to address the open container issue from caps with close fitting holes through which the tubing passes to devices that feature internal valving. These solutions, while successful to a point, still leave room for improvement. For example, in one type of dispensing system design, the opening of a bottle is closed by a throat plug that has a valve, which is normally closed. However, when a cap is mounted on the container, the valve automatically opens so as to permit fluid flow from the container. The valve in the throat plug contains a spring, which is compressed when the cap is installed. As the spring compresses, the valve opens. When the cap is removed, the spring expands so as to again close the valve. The repeated compression and decompression of the spring over time causes the spring to lose its resiliency. This loss of resiliency in the spring can create conditions in which the valve does not completely close such that leakage from the container can occur. In addition, these type of valve designs can create variable valve opening sizes, which in turn can restrict the flow rate and/or make the flow rate inconsistent. Moreover, the plug can be easily removed, thereby creating safety concerns. Typically, the spring is metallic, and the rest of the valve is plastic. With the metallic spring, recycling difficulties can be created.

These types of dispensing systems also require a high tolerance finish on the neck of the bottle so that no leakage occurs from the cap or plug. This high tolerance neck finish can make manufacturing of containers, such as blow molded containers, difficult. If the tolerance is not met, leakage from the container can result. Since the chemicals in the containers are typically stored in an undiluted or highly concentrated state, the chemicals tend to be very hazardous. It is therefore desirable that the closure for the containers be very difficult to remove once installed so as to avoid exposure to potentially hazardous chemicals. Given that the high tolerance neck finishes on containers, like blow molded plastic bottles, is technically difficult and/or economically impractical, most of the responsibility for sealing the container and preventing reopening of the container falls on the closure for the container. However, due to geometries involved with traditional closures, it is difficult to manufacture a closure with structures that prevent removal of the cap or closure from the container. For instance, with traditional plastic molding, anti-removal structures formed on the closure tend to make removal or stripping of the closure from the molds difficult, if not practically impossible. Due to their very nature, the anti-removal structures tend to hamper unscrewing of the closure from molds during ejection.

Thus, needs remain for further contributions in this area of technology.

SUMMARY OF THE INVENTION

One aspect of the present invention concerns a fluid dispensing system. The fluid dispensing system includes a closure assembly. The closure assembly is configured to enclose a container opening. The closure assembly has a fluid supply tube with an opening and a shut-off valve threadedly coupled to the supply tube. The shut-off valve has a valve member configured to close the opening in the supply tube upon rotating the shut-off valve in a first direction and to open the opening in the supply tube upon rotating the shut-off valve in a second direction. A cap assembly is coupled to the closure assembly. The cap assembly has a connector member with a fluid passage fluidly coupled to the supply tube. The cap assembly is coupled to the shut-off valve to rotate the shut-off valve in the first direction and the second direction.

Another aspect concerns a fluid dispensing system. The system includes a closure assembly, which includes a shut-off valve for controlling the dispensing of fluid from a container upon rotation of the shut-off valve. A cap assembly is coupled to the shut-off valve of the closure assembly. The cap assembly includes a tube connector constructed and arranged to supply the fluid from the container to a dispensing tube. The cap assembly is constructed and arranged to open and close the shut-off valve upon rotation of the cap assembly in opposite directions.

A further aspect concerns a fluid dispensing kit. The kit includes a closure assembly constructed and arranged to enclose a container. The closure assembly includes a shut-off valve for controlling the dispensing of fluid from the container upon rotation of the shut-off valve. A transit cap is constructed and arranged to couple to the closure assembly and prevent rotation of the shut-off valve when the transit cap is coupled to the closure assembly.

Still yet another aspect concerns a fluid dispensing system. The system includes a closure assembly constructed and arranged to enclose a container. The closure assembly includes a shut-off valve constructed and arranged to close upon rotating the shut-off valve in a first direction and to open upon rotating the shut-off valve in a second direction. A container engagement collar has an internal thread engageable with threading on the container. A closure body is coupled to the collar in a ratcheting manner in which the engagement member is only able to rotate in a tightening direction relative to the closure body to increase the difficulty in removing the closure assembly from the container.

A further aspect concerns a container engagement collar. The container engagement collar includes a collar body that has an internal thread engageable with threading of a container. The collar body defines a groove in which one or more retention tabs of a closure body are slidably received to permit relative movement between the collar body and the closure body. The collar body has one or more fingers configured to engage notches in the closure body in a ratcheting manner.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
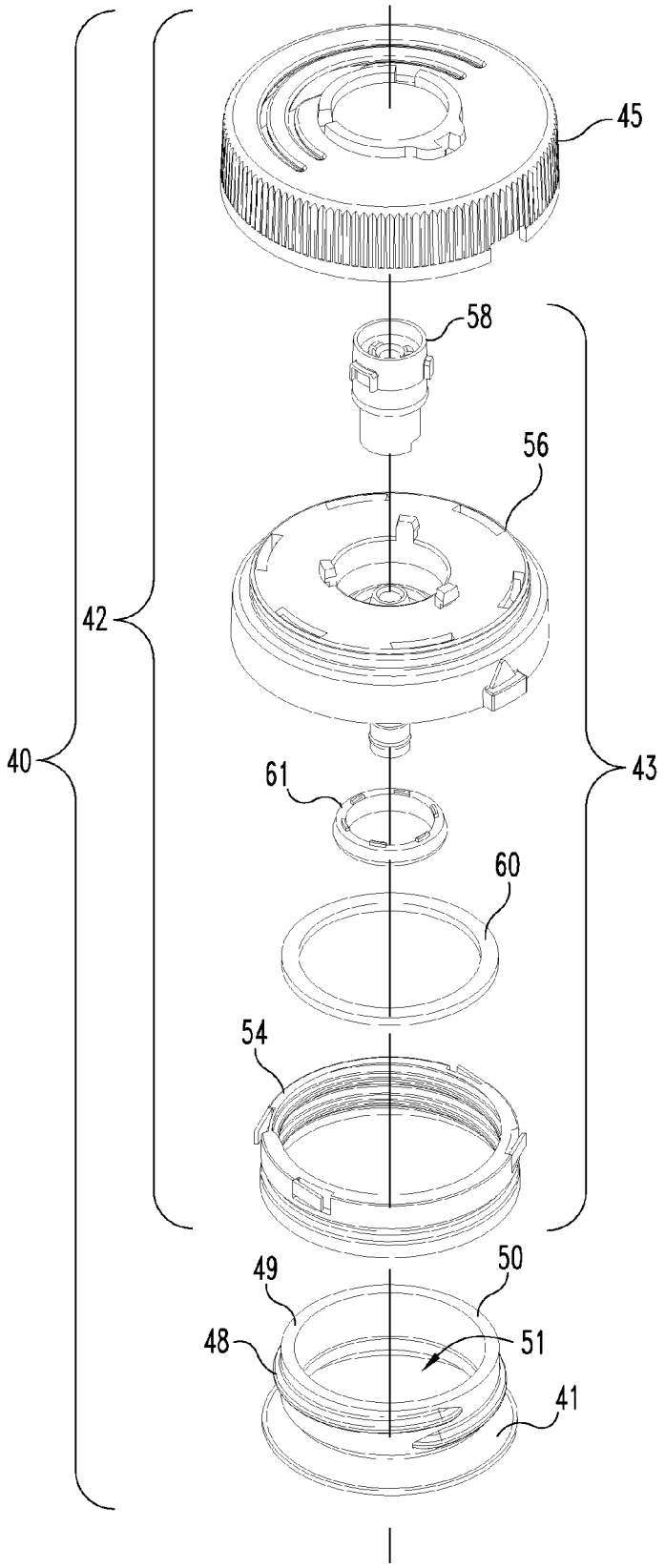
FIG. 1 is an exploded view of a container and a container shipping assembly according to one embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein, are contemplated as would normally occur to one skilled in the art to which the invention relates. One embodiment of the invention is shown in great detail, although it will be apparent to those skilled in the art that some features that are not relevant to the present invention may not be shown for the sake of clarity. It should be noted that directional terms, such as "up", "upwards", "down", "downwards", "top" and "bottom", are used herein solely for the convenience of the reader in order to aid in the reader's understanding of the illustrated embodiments, and it is not the intent that the use of these directional terms in any manner limit the described, illustrated, and/or claimed features to a specific direction or orientation.

Figure 3:
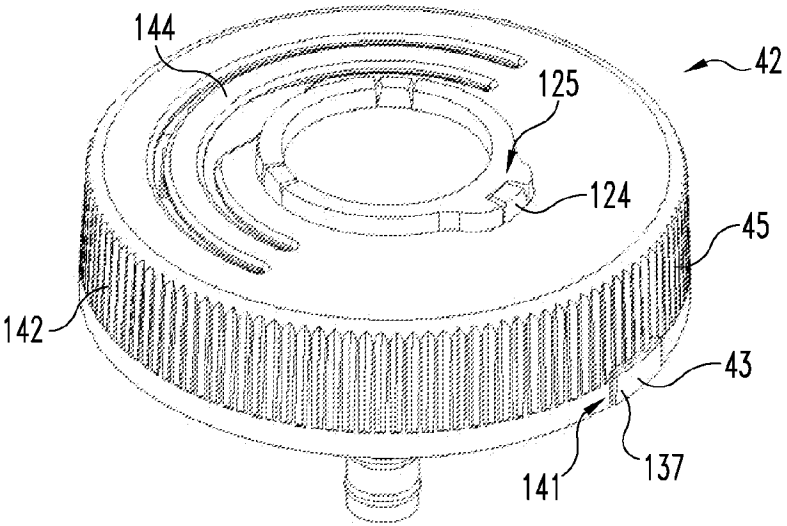
FIG. 3 is a perspective view of the FIG. 1 shipping assembly.
Figure 2:
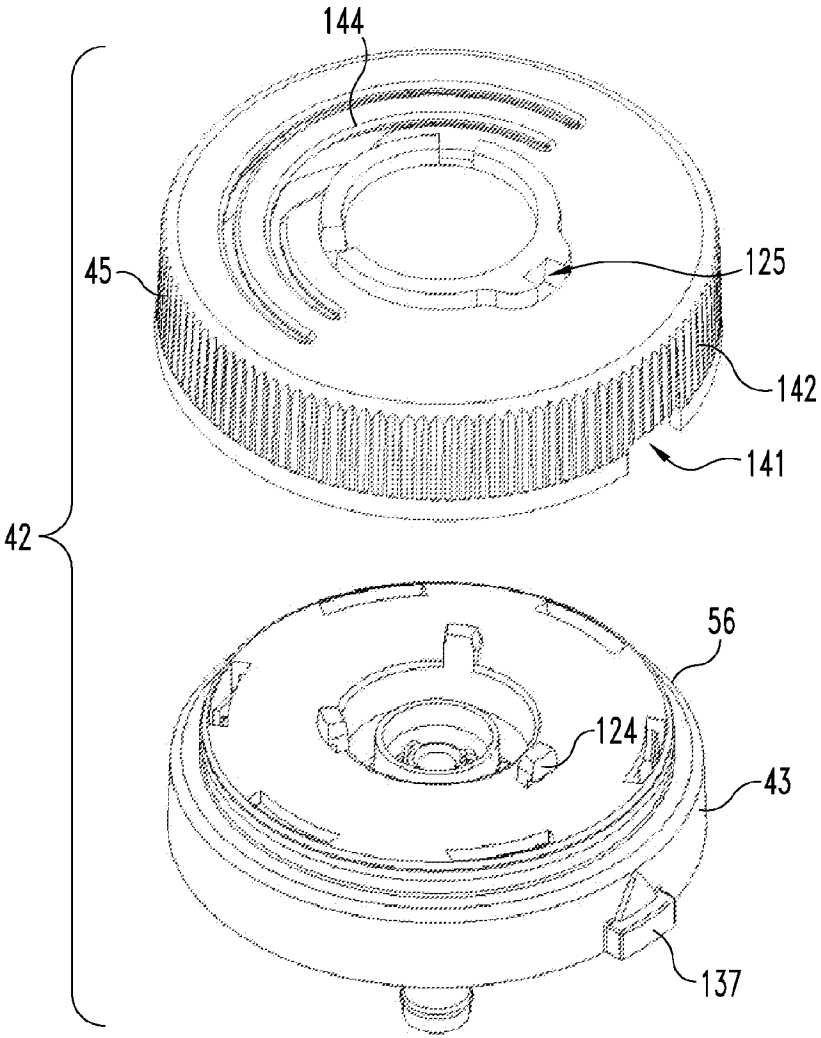
FIG. 2 is a first exploded view of a transit cap and closure assembly, which are components of the FIG. 1 shipping assembly.
Figure 4:
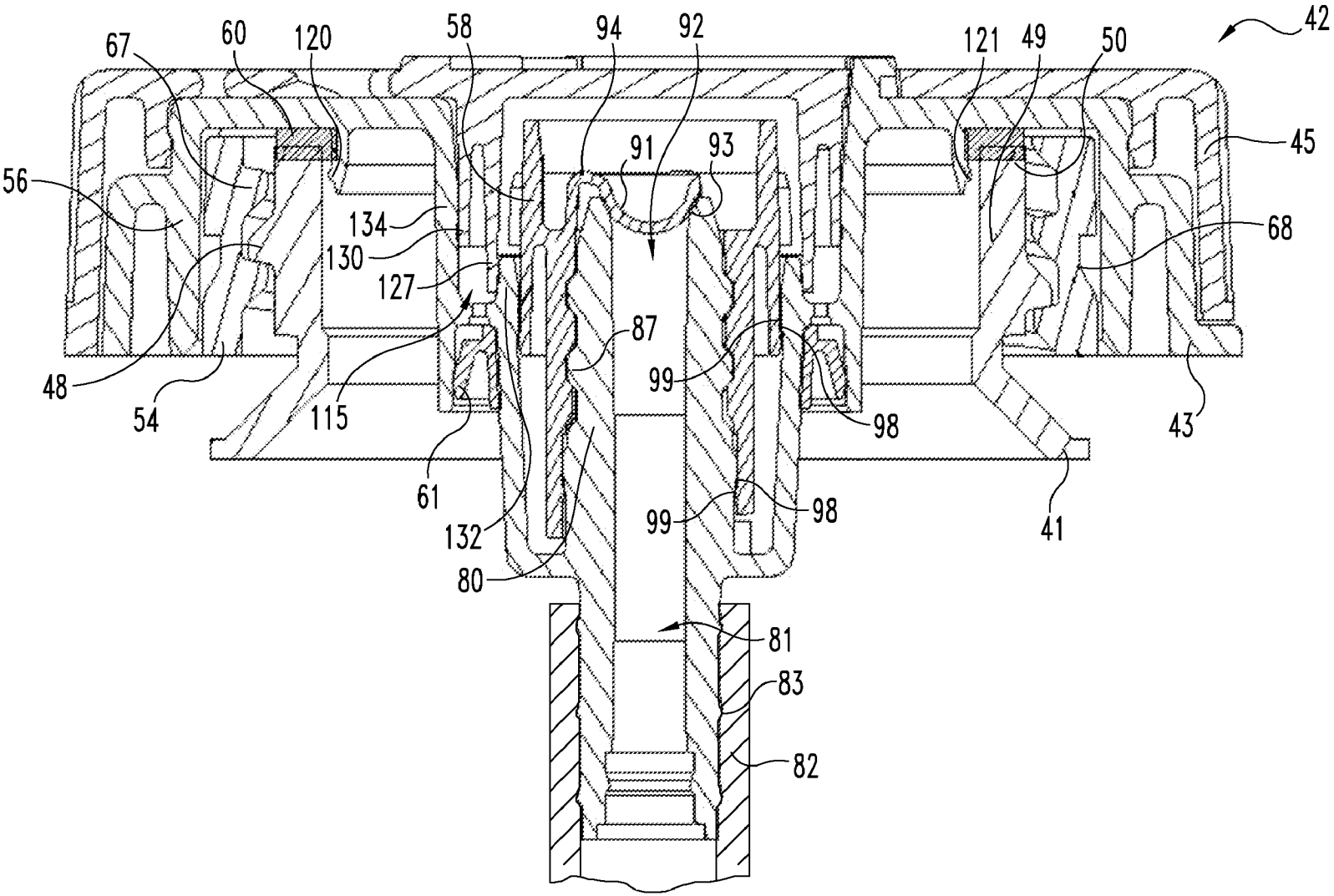
FIG. 4 is a cross sectional view, in full section, of the FIG. 1 shipping assembly.
Figure 5:
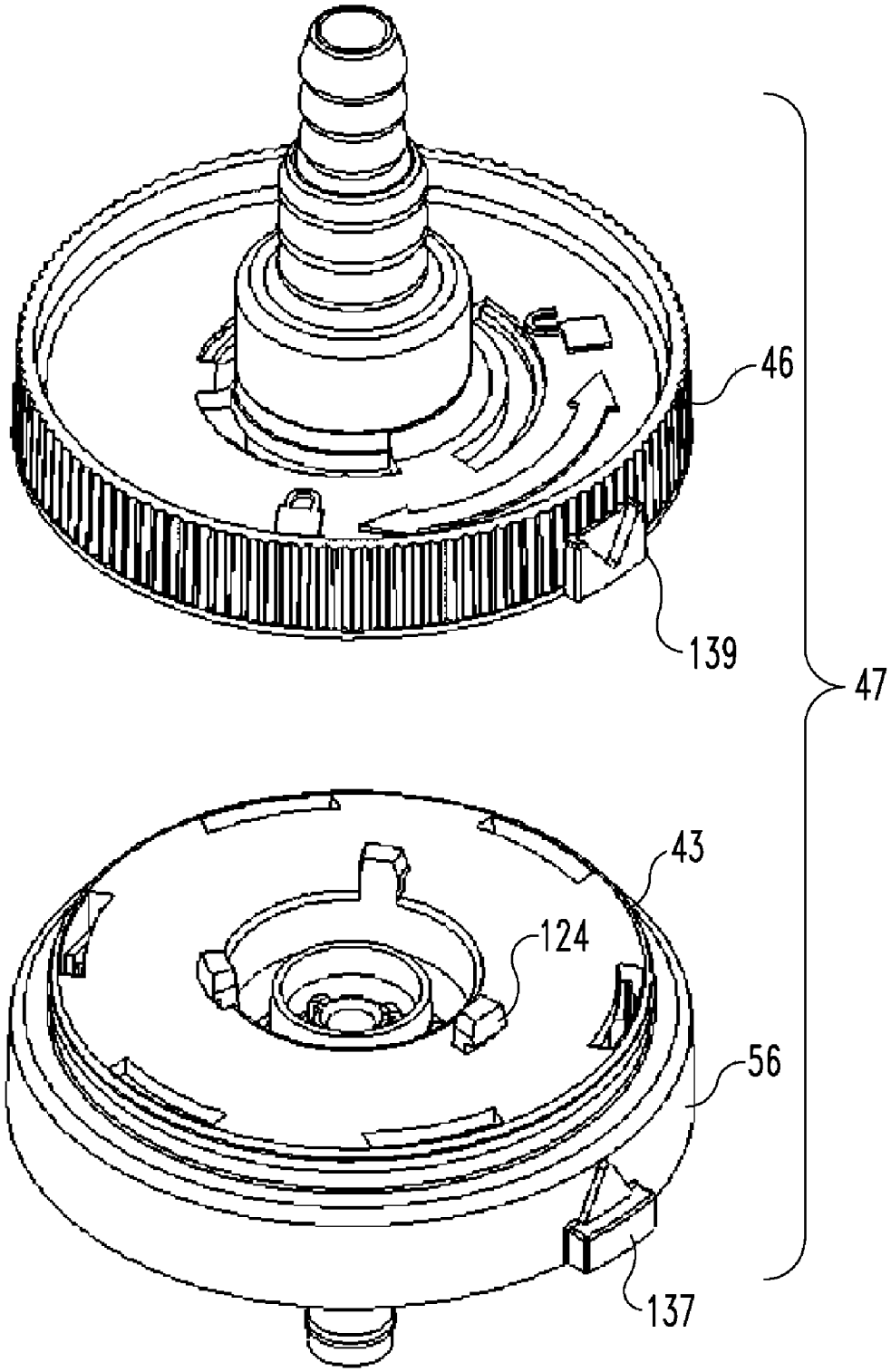
FIG. 5 is an exploded view of a fluid dispensing system according to one embodiment that incorporates the FIG. 2 closure assembly.
Figure 7:
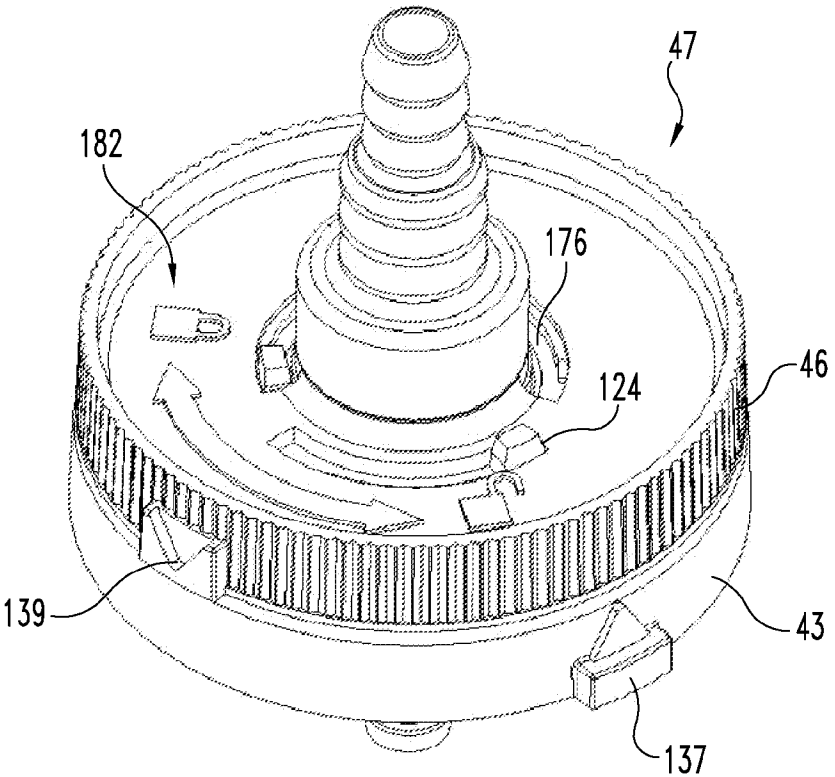
FIG. 7 is a perspective view of the FIG. 5 dispensing system with the FIG. 5 dispensing system in the opened position.
Figure 6:
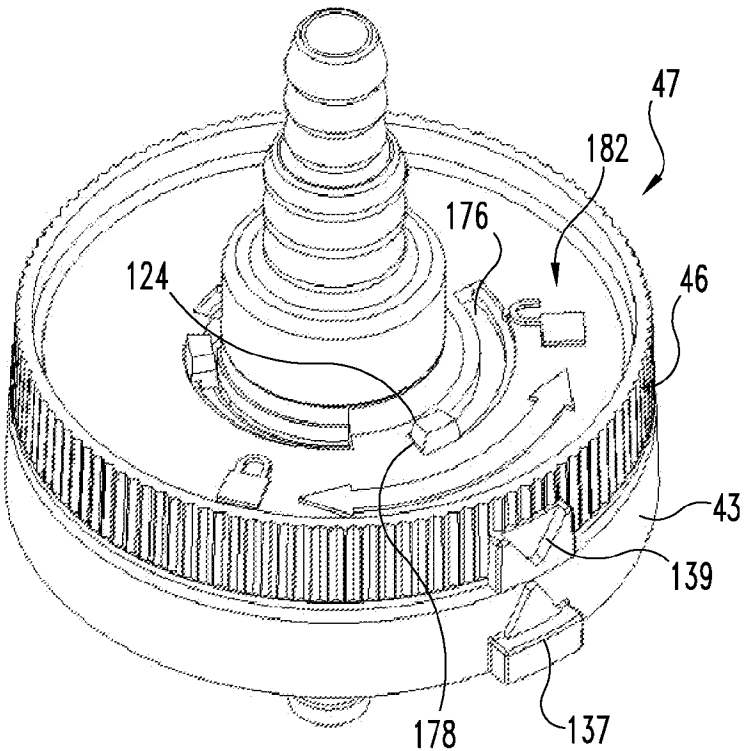
FIG. 6 is a perspective view of the FIG. 5 dispensing system with the FIG. 5 dispensing system in the closed position.

A container-shipping assembly 40, according to one embodiment of the present invention (among many other embodiments), is illustrated in FIG. 1. As depicted, the container-shipping assembly 40 includes a container 41 that is fitted with a shipping closure system 42. The shipping closure system 42 generally includes two subassemblies, a closure assembly 43 that is attached to the container 41 and a transit cap 45 that protects the closure assembly 43 during shipping or handling. As will be described in further detail below, the configuration of the transit cap 45 further aids in capping the closure assembly 43 onto the container 41. As shown in FIGS. 2, 3 and 4, the transit cap 45 is attached to the closure assembly 43 before transit so that the closure assembly 43 does not become damaged during shipping and accidentally spill fluid from the container 41. Before fluid can be dispensed from the container 41, the transit cap 45 is removed from the closure assembly 43. As will be discussed in greater detail below, the closure assembly 43 is configured to seal and control the dispensing of fluid from the container 41. To dispense the fluid from the container 41 (after the transit cap 45 has been removed), a cap assembly 46 is attached to the closure assembly 43 in order to form a fluid dispensing system 47, as is shown in FIGS. 5, 6 and 7. In the illustrated embodiment, the cap assembly 46 is rotated in a clockwise fashion relative to the closure member 43 to permit dispensing of fluid from the container 41, and the cap assembly 46 is rotated in a counter-clockwise fashion to reseal the container 41. It should be appreciated that in other embodiments the cap assembly 46 can be configured to rotate in an opposite manner so as to open and close the container 41.

Referring to FIG. 1, the closure assembly 43 is constructed and arranged to threadedly engage threading 48 on neck 49 of the container 41. The neck 49 of the container 41 has a rim 50 that surrounds a container opening 51 from which fluid is poured into and dispensed from the container 41. For the sake of clarity, the entire body of the container 41 is not illustrated in FIG. 1. Nevertheless, it should be appreciated that the container 41 has a closed end that is capable of storing liquids. In one form, the container 41 is configured to store hazardous liquids, such as concentrated cleaning fluids. As should be appreciated, the container 41 can be configured to store other types of liquids. In one particular form, the container 41 is a blow-molded container, such as a bottle.

The closure assembly 43 is constructed and arranged to form a positive seal with the neck 49 of the container 41. As shown in FIGS. 1 and 4, the closure assembly 43 includes a container engagement member or collar 54 that secures the closure assembly 43 to the container 41. In the illustrated embodiment, the container engagement member 54 is in the form of an internally threaded ring. The container engagement member 54 is coupled to a closure body 56 in the closure assembly 43, and a shut-off valve 58, which controls fluid flow from the container 41, is coupled to the closure body 56. The closure assembly 43 further includes a container seal 60 that forms a seal between the closure body 56 and the rim 50 of the container 41 (FIG. 4) and a vent valve 61 for venting air into the container 41.

Figure 8:
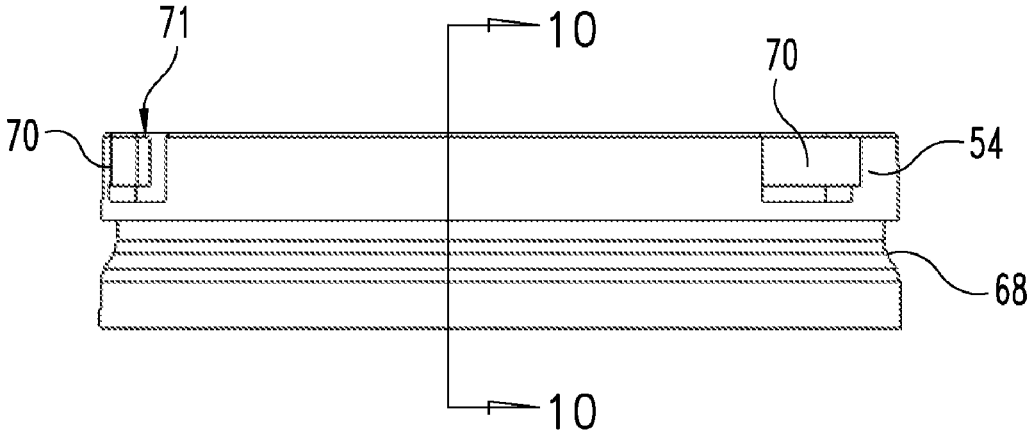
FIG. 8 is a front view of a container engagement member, which is a component of the FIG. 2 closure assembly.
Figure 9:
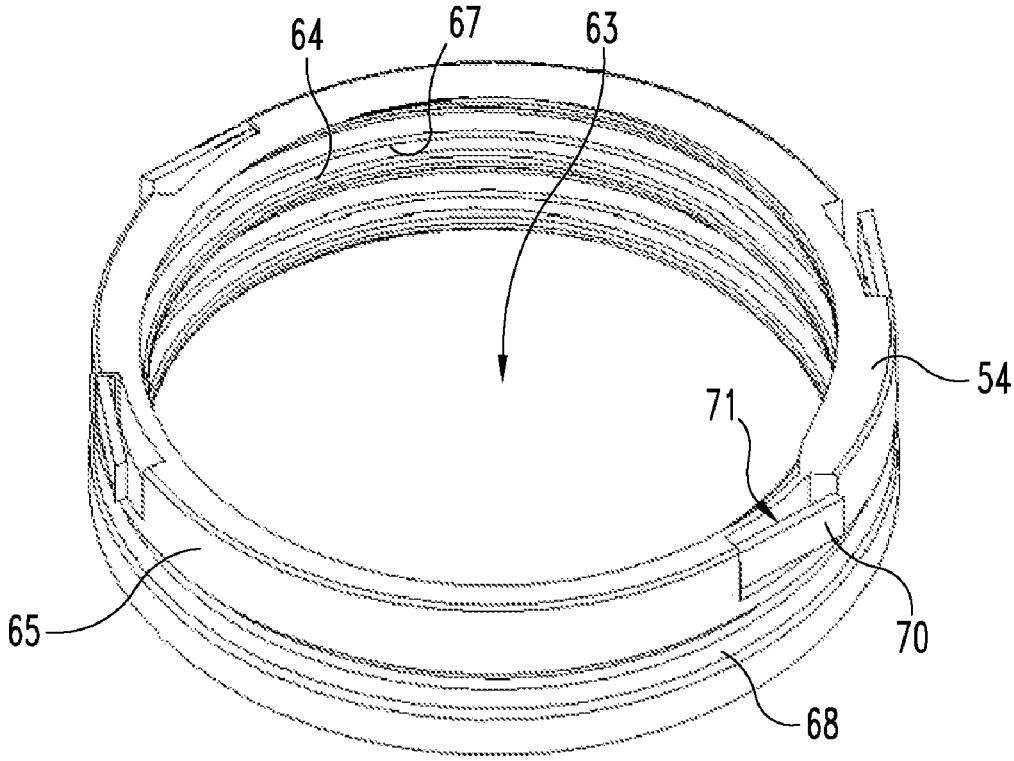
FIG. 9 is a perspective view of the FIG. 8 container engagement member.
Figure 10:
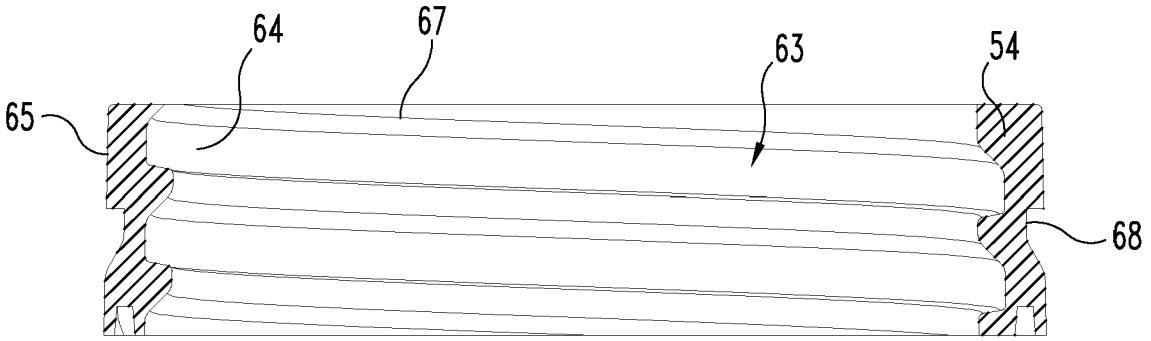
FIG. 10 is a cross sectional view, in full section, of the FIG. 8 container engagement member as taken along line 10-10 in FIG. 8.

With reference to FIGS. 8, 9 and 10, the container engagement member 54 is configured rotate independently of the closure body 56 in one direction so that the closure assembly 43 can be easily secured to the container 41 but cannot be easily removed. In the illustrated embodiment, engagement member 54 is generally ring shaped and defines a central opening 63. Around the central opening 63, the container engagement member 54 has an inner radial wall 64 and an outer radial wall 65. The inner wall 64 has container engagement threading 67 that is configured to engage the threading 48 of the container 41. The outer radial wall 65 defines a groove 68 at which the container engagement member 54 is secured to the closure body 56 and one or more fingers 70 that only allows the container engagement member 54 to rotate in one direction relative to the closure body 56. Fingers 70 extend from and are resiliently attached to the outer radial wall 65, as is shown in FIG. 9. The outer radial wall 65 further defines deflection notches 71 at each finger 70 so as to allow the fingers 70 to deflect in a radially inward direction.

Figure 12:
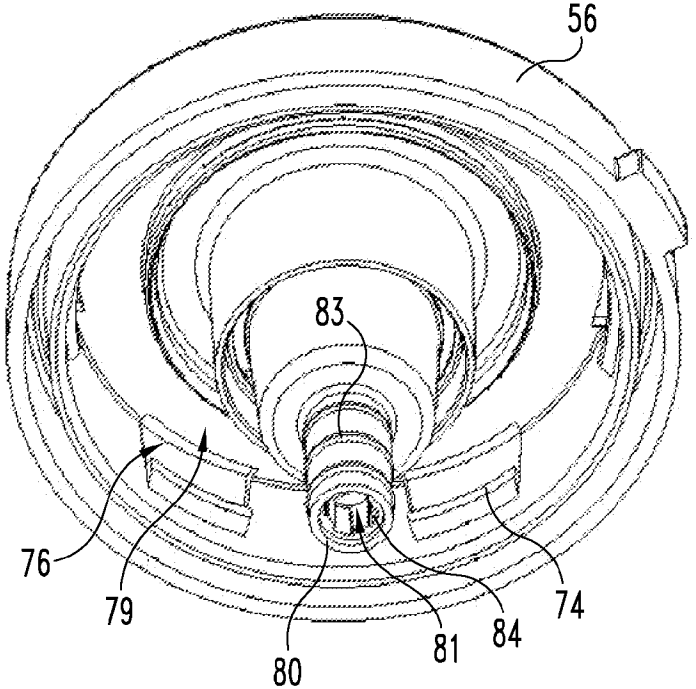
FIG. 12 is a bottom perspective view of the FIG. 11 closure body.
Figure 11:
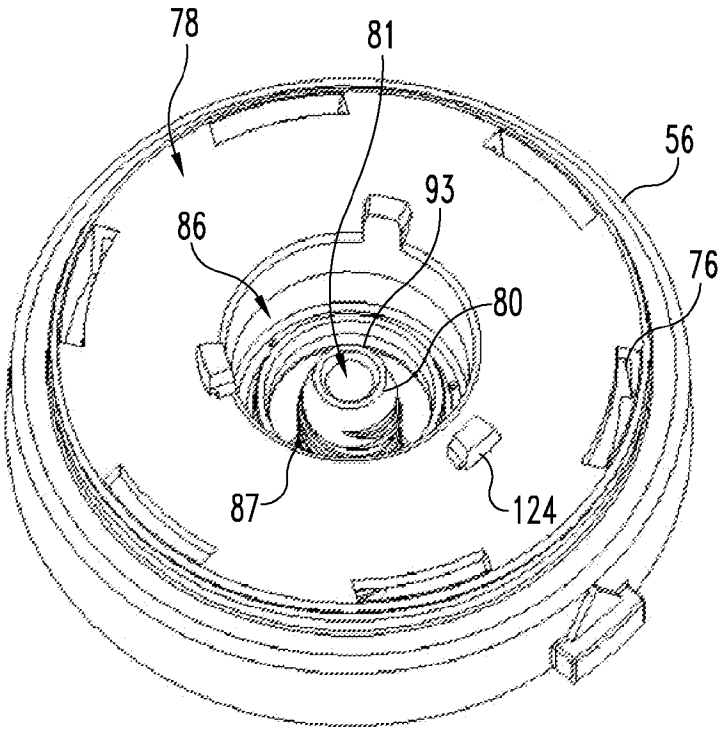
FIG. 11 is a top perspective view of a closure body, which is a component of the FIG. 2 closure assembly.
Figure 13:
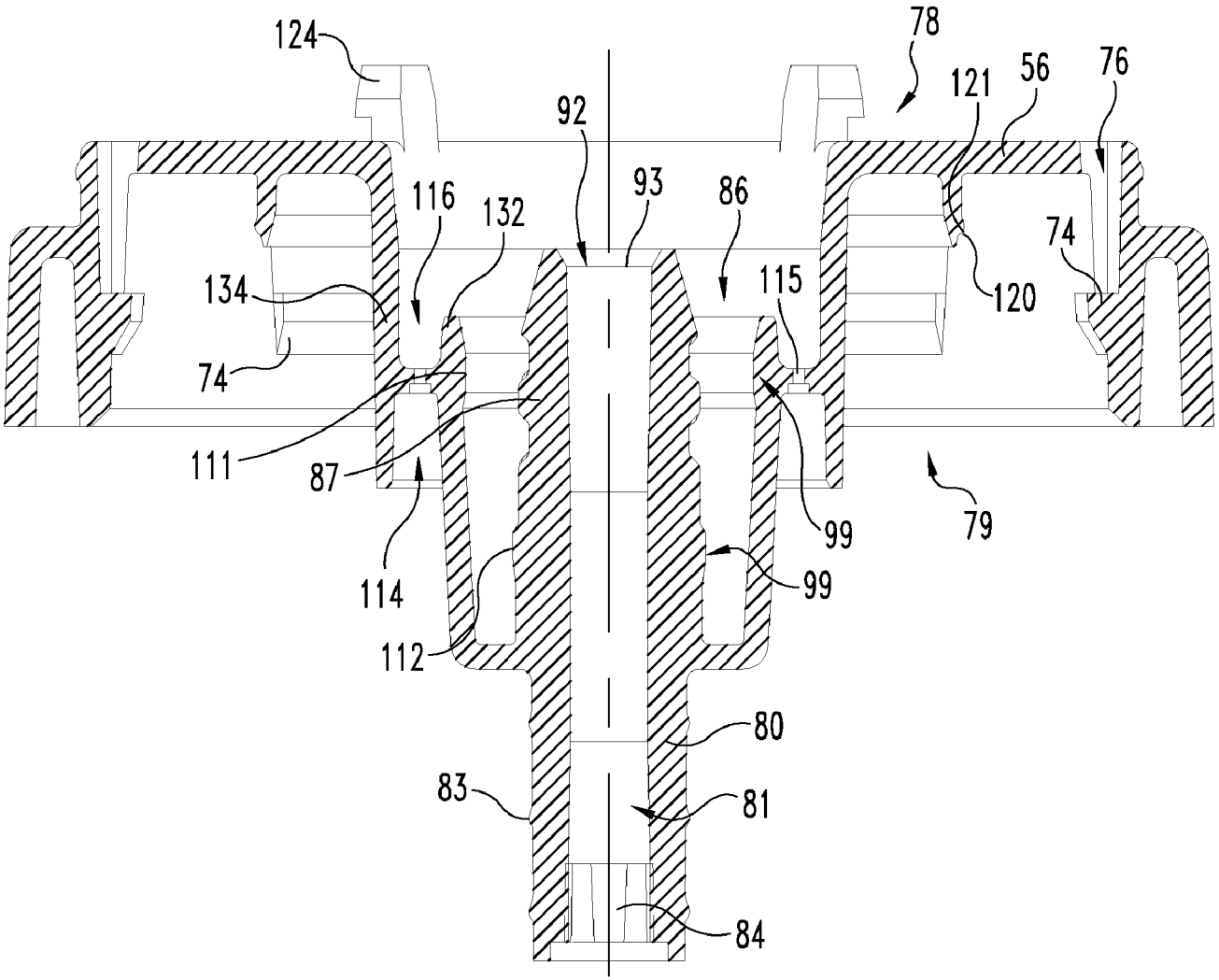
FIG. 13 is a cross sectional view, in full section, of the FIG. 11 closure body.
Figure 14:
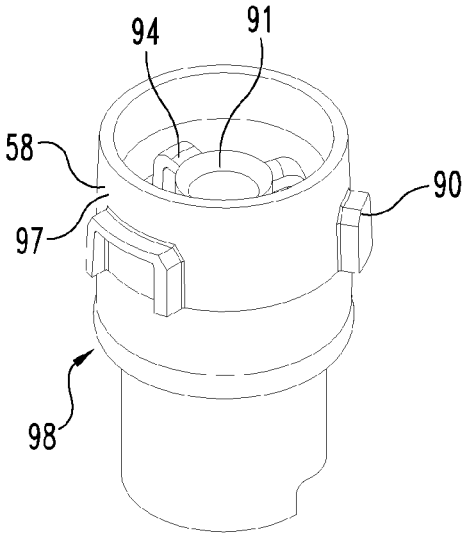
FIG. 14 is a top perspective view of a shut-off valve, which is a component of the FIG. 2 closure body.
Figure 15:
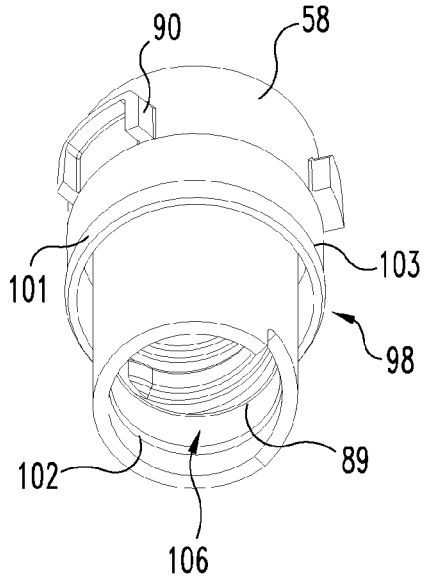
FIG. 15 is a bottom perspective view of the FIG. 14 shut-off valve.
Figure 16:
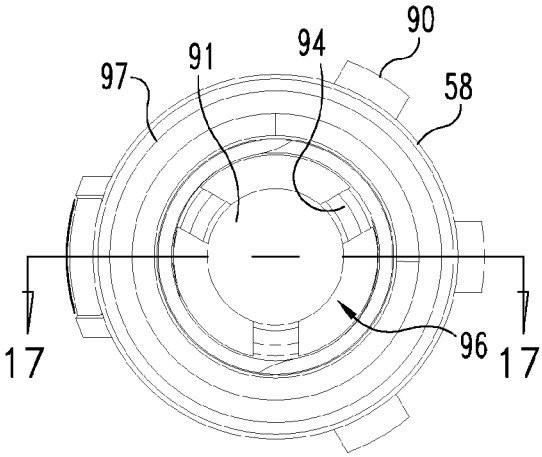
FIG. 16 is a top, elevational view of the FIG. 14 shut-off valve.

In order to secure the container engagement member 54 to the closure body 56, the closure body 56 has one or more retention tabs 74 that snap into the groove 68 of the container engagement member 54, as is shown in FIGS. 12 and 13. Referring to FIG. 9, the groove 68 in the illustrated embodiment is continuous and extends three hundred and sixty degrees (360°) around the container engagement member 54. With the tabs 74 engaged in the groove 68, the container engagement member 54 is able to rotate freely while at the same time remain attached to the closure body 56. In one form, the closure body 56 is created through a molding process. To mold the retention tabs 74, as depicted in FIGS. 11, 12 and 13, the closure body 56 has core out notches 76. The fingers 70 on the container engagement member 54 are configured to engage the notches 76 in the closure body 56 so as to act as a ratchet, thereby only permitting the container engagement member 54 and the closure body 56 to rotate in one direction. When the closure body 56 is attached to the container engagement member 54, such as during capping, the fingers 70 are compressed inside the deflection notches 71. After the retention tabs 74 on the closure body 56 are snapped into the groove 68, the fingers 70 are able spring back so that the fingers 70 are able to engage the core out notches 76 in the closure body 56. To secure or tighten the closure assembly 43 onto the container 41, the closure body 56 is rotated so that the fingers 70 engage the core out notches 76, which in turn causes the container engagement member 54 to rotate. When an attempt is made to remove the closure assembly 43 by rotating the closure body 56 in the opposite direction, the fingers 70 disengage from the core out notches 76 in a ratcheting fashion. As a result, the container engagement member 54 remains engaged with the neck 49 of the container 41 while the rest of the closure assembly 43 rotates.

Figure 9A:
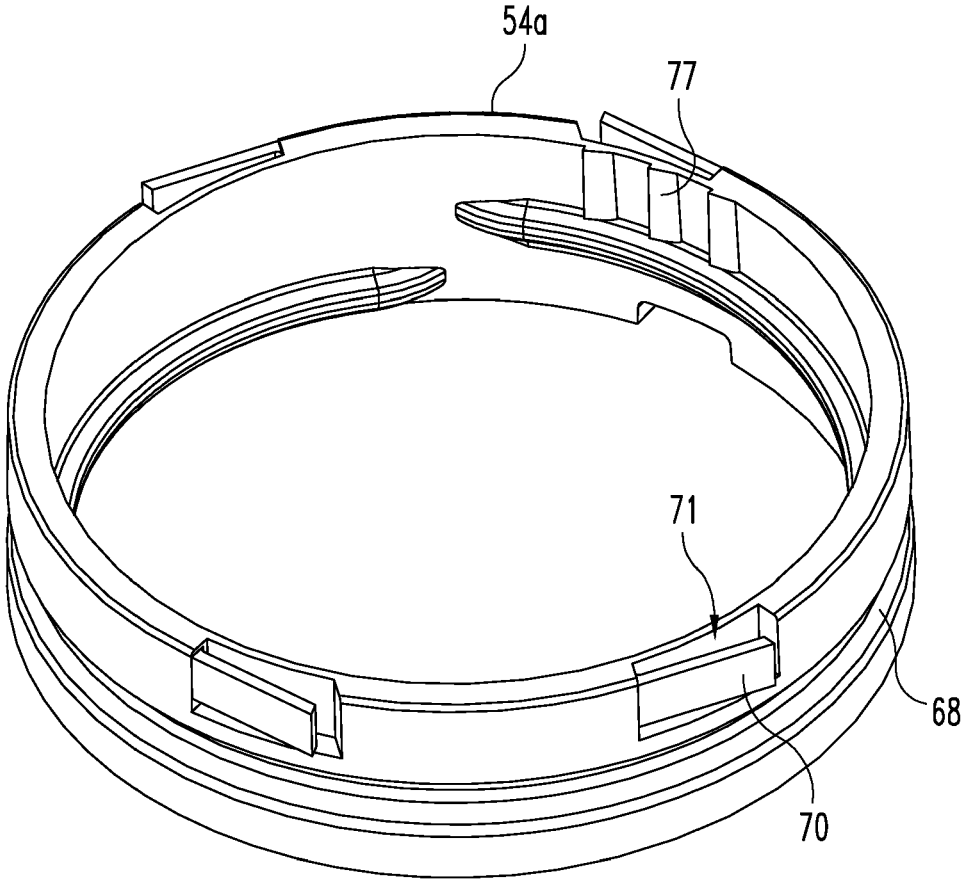
FIG. 9A is a perspective view of a container engagement member according to another embodiment.

The above arrangement increases the difficulty of gaining access to the interior of the container 41, thereby reducing the potential for unauthorized mixing of and exposure to chemical concentrates. The configuration of the container engagement member 54 allows for the molding of details into threads 67 that contributes to the difficulty of the removal of the closure assembly 43. For example, the major diameter can be reduced to increase interference with the finish of the container neck 49. In another embodiment, as illustrated in FIG. 9A, teeth 77 are added to container engagement member 54*a* to allow closure, but the teeth 77 are arranged to bite into the major diameter of the container 41, thereby limiting backward movement of the container engagement member 54*a*. The use of the container engagement member 54 provides a secure manner for retaining the contents of the container 41 in the event of the container 41 being knocked over or dropped. As should be appreciated, the closure assembly 43 according to the present invention can be easily threaded onto a standard container neck finish with conventional capping equipment.

As depicted in FIGS. 5, 11 and 12, the closure body 56 has a cap facing side 78 that faces the transit cap 45 during transport as well the cap assembly 46 during dispensing of fluid and an opposite container facing side 79 that faces the container 41. A fluid supply tube 80 extends from the container facing side 79 to the cap facing side 78. With reference to FIG. 13, the fluid supply tube 80 defines a fluid passageway 81 through which fluid is dispensed from the container 41. In one embodiment, the container 41 supplies fluid to the fluid supply tube 80 via tubing 82, which is illustrated in FIG. 4. On the container facing side 79, the supply tube 80 has tubing engagement ridges 83 that engage and form a seal with the tubing 82. Referring to FIGS. 12 and 13, inside the fluid supply tube 80, the closure body 56 has one or more meter engagement ribs 84 to which a metering orifice member can be optionally attached. Depending on the requirements of an application, differently sized metering orifice members can be attached to the meter engagement ribs 84 in order to adjust the flow rate of fluid from the container 41. In one embodiment, the metering orifice member is externally threaded such that the metering orifice member is able to self-tap and thread itself into the meter engagement ribs 84.

Figure 17:
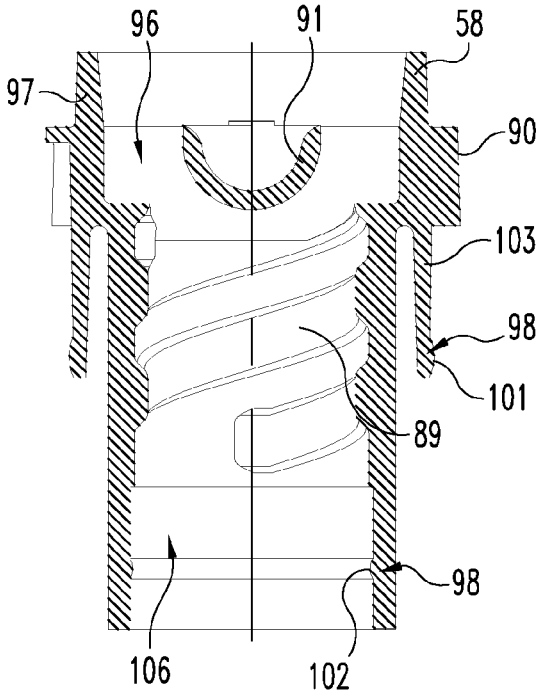
FIG. 17 is a cross sectional view, in full section, of the FIG. 14 shut-off valve as taken along line 17-17 in FIG. 16.

Referring again to FIG. 13, the closure body 56 on the cap facing side 78 defines a shut-off valve receptacle 86 in which the shut-off valve 58 is coupled to the closure body 56. As shown, the supply tube 80 extends within the valve receptacle 86, and the supply tube 80 is externally threaded with valve engagement threading 87. The shut-off valve 58, as illustrated in FIG. 17, has internal threading 89 that is configured to engage the valve threading 87 on the supply tube 80. According to one embodiment of the present invention, the valve engagement threading 87 is threaded in an opposite manner as compared to the threading 48 on the container 41. So for example, in the embodiment illustrated in FIG. 4, the threading 48 on the container 41 is a right-handed thread, whereas the valve threading 87 on the closure body 56 is a left-handed thread. It is contemplated that in other embodiments the threading 48 on the container 41 can be left-handed, and the threading 87 on the supply tube 80 can be right-handed. As should be appreciated, this opposite threading arrangement allows the shut-off valve 58 to be readily opened even with tamper resistant capability provided by the container engagement member 54. In contrast, if the threading 87 on the supply tube 80 were threaded in the same direction as the threading 48 on the container 41, it would be difficult to open the shut-off valve 58 because the closure body 56 would rotate freely relative to the container engagement member 54.

As compared to dispensing system designs which simply require vertical compression of a spring to open a valve, the shut-off valve 58 according to the present invention requires rotary movement between the shut-off valve 58 and the closure assembly 43. Moreover, with no springs involved, the closure member 43 can dispense fluid with a more consistent flow rate and a relatively large flow rate over time.

The shut-off valve 58, which is depicted in FIGS. 14, 15, 16 and 17, has one or more key members 90 that are configured to engage the cap assembly 46. Key members 90 extend in a radially outward direction from the shut-off valve 58. In one embodiment, the key members 90 are arranged around the shut-off valve 58 so that only selected cap assemblies 46 can be mounted on the closure assembly 43. These keys 90 can be matched with certain chemicals so that dedicated proportioners will not accidentally be hooked up to an incorrect chemical concentrate. With additional reference to FIGS. 4 and 13, the shut-off valve 58 has a valve member 91 that is used to seal fluid opening 92 of the fluid passageway 81 in the closure body 56. Around the fluid opening 92, the supply tube 80 has a valve seat 93 that is constructed and arranged to seal against the valve member 91. To open the shut-off valve 58, the valve 58 is rotated in a clockwise manner, and to close the valve 58, the shut-off valve 58 is rotated in a counterclockwise fashion. However, it should be appreciated that in other embodiments the shut-off valve 58 can be rotated in an opposite fashion in order to open and close. In the illustrated embodiment, the valve member 91 has a semi-spherical shape, and the valve seat 93 has a conical shape. It is contemplated that in other embodiments the valve member 91 and the valve seat 93 can be shaped differently. The valve member 91 is attached to the rest of the shut-off valve 58 via one or more support arms 94. Between the valve member 91 and the support arms 94, the shut-off valve 58 has one or more valve openings or orifices 96 through which fluid from passageway 81 flows when the shut-off valve 58 is open. Surrounding the valve openings 96, the shut-off valve 58 has a cap connection cup 97 that is designed to engage the cap assembly 46. As shown, the key members 90 radially extend from the connection cup 97.

The shut-off valve 58 and the closure body 56 are configured to prevent fluid leakage from the container 41 and limit air infiltration into the fluid stream when the valve 58 is open. The interface between the seals 98 and seats 99 prevent air leaks that could interfere with proper dilution. As shown in FIGS. 13 and 17, the shut-off valve 58 is provided with a pair of diametric seals 98 that are arranged to interface with cooperating seats 99 in the closure body 56. The seals 98 are positioned such that the seals 98 are not engaged when the shut-off valve 58 is closed. In the shut-off valve 58 of FIG. 17, the seals 98 include a first seal ridge 101 and a second seal ridge 102. The first seal ridge 101 extends in a radial outward direction from a valve skirt 103 of the shut-off valve 58. As depicted, the valve skirt 103 is positioned proximal to the valve member 91. Near the end that is opposite the valve member 91, the second seal ridge extends in a radially inward direction inside a tube cavity 106 that is defined in the shut-off valve 58. In the closure body 56 of FIG. 13, the seats 99 include a first seat 111 and a second seat 112 that are positioned to respectively seal with the first seal ridge 101 and the second seal ridge 102 when the shut-off valve 58 is in the opened position. The seals 98 and seats 99 are positioned in the closure assembly 43 such that they are not engaged when the shut-off valve is closed. Engagement takes place when the valve 58 is opened. In this manner plastic hoop strength is maintained in shipping and storage, as there is no stress on the seals 98 and seats 99 until they are placed in service.

Figure 19:
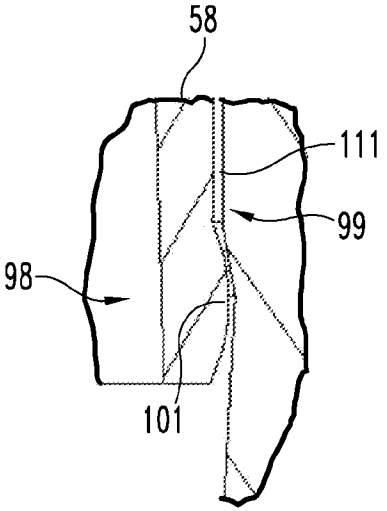
FIG. 19 is an enlarged cross sectional view of a first seal ridge of the FIG. 14 shut-off valve disengaged from the FIG. 11 closure body when the FIG. 14 shut-off valve is in the closed position.
Figure 20:
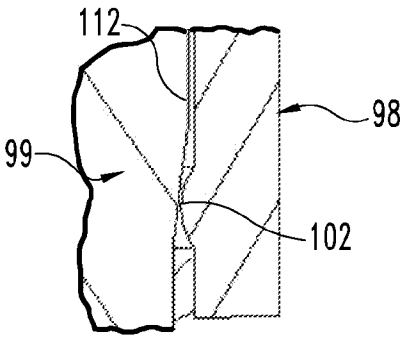
FIG. 20 is an enlarged cross sectional view of a second seal ridge of the FIG. 14 shut-off valve disengaged from the FIG. 11 closure body when the FIG. 14 shut-off valve is in the closed position.
Figure 18:
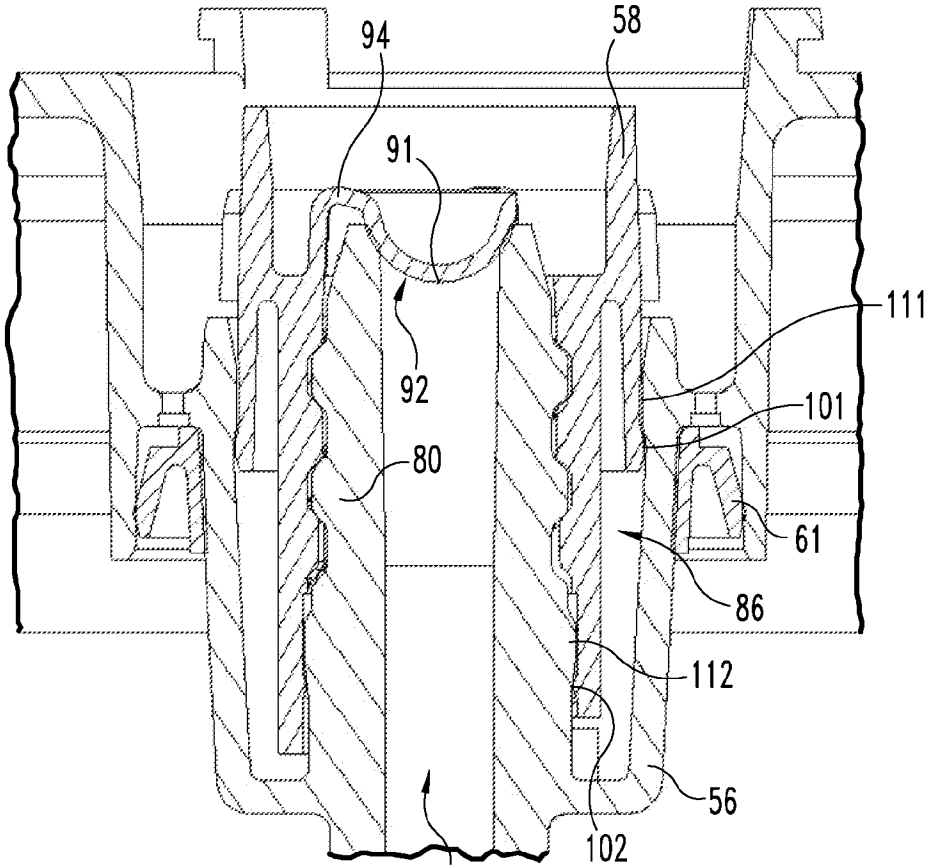
FIG. 18 is a cross sectional view of the FIG. 2 closure assembly when the FIG. 14 shut-off valve is in the closed position.

FIGS. 18, 19 and 20 illustrate the relative positions of the seals 98 and seats 99 when the shut-off valve 58 is closed. In particular, FIG. 19 depicts the relative positions of the first seal ridge 101 and the first seat 111, and FIG. 20 illustrates the relative positions of the second seal ridge 102 and the second seat 112. As shown, when the valve 58 is closed such that fluid is unable to flow from opening 92, the seals 98 and seats 99 are disengaged from one another. In the illustrated embodiment, the seals 98 of the shut-off valve 58 are positioned below the seats 99 of the closure body 56 when the shut-off valve 58 is closed.

Figure 22:
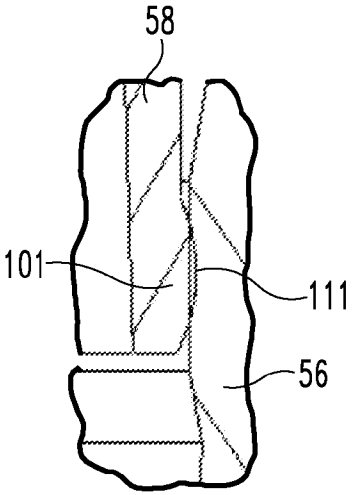
FIG. 22 is an enlarged cross sectional view of the first seal ridge of the FIG. 14 shut-off valve sealed against the FIG. 11 closure body when the FIG. 14 shut-off valve is in the opened position.
Figure 23:
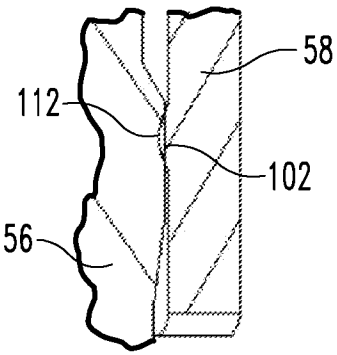
FIG. 23 is an enlarged cross sectional view of the second seal ridge of the FIG. 14 shut-off valve sealed against the FIG. 11 closure body when the FIG. 14 shut-off valve is in the opened position.
Figure 21:
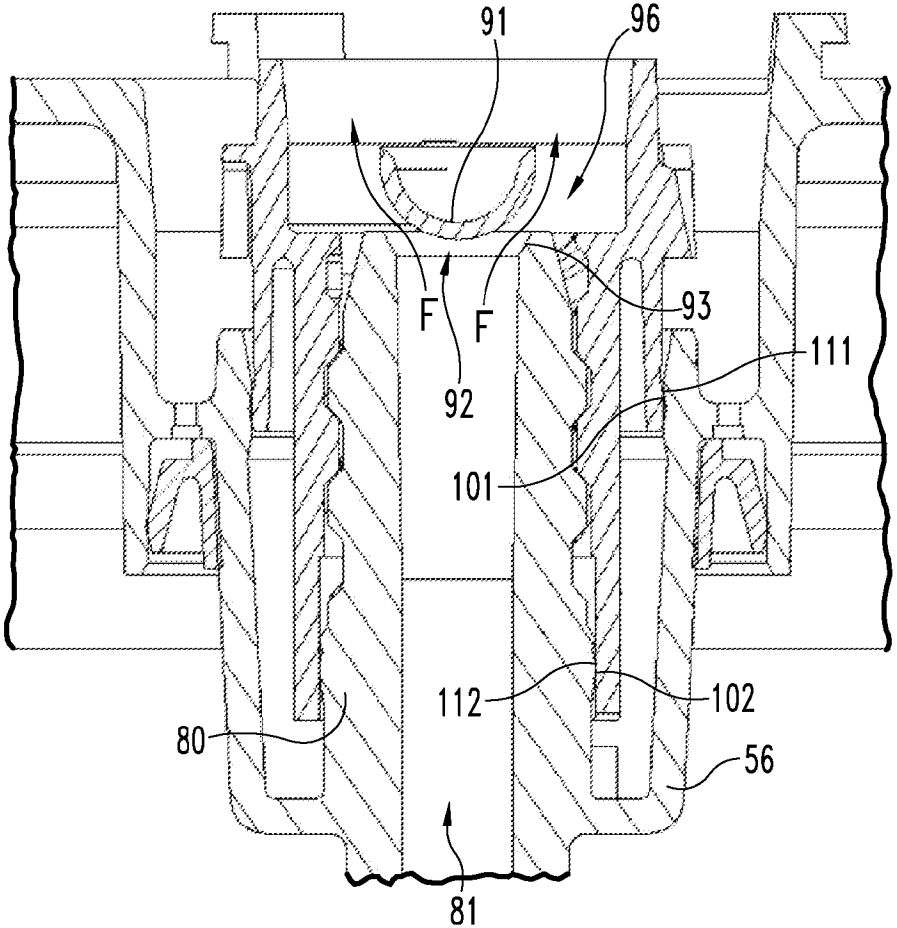
FIG. 21 is a cross sectional view of the FIG. 2 closure assembly when the FIG. 14 shut-off valve is in the opened positioned.

When the shut-off valve 58 is turned clockwise, the valve member 91 is lifted from the valve seat 93, thereby allowing the fluid to flow from the container 41. As indicated by flow arrows F in FIG. 21, the fluid flows from the opening 92 of the supply tube 80 and through the valve orifices 96 of the shut-off valve 58 while the shut-off valve 58 is in the opened position. During opening of the valve 58, the valve 58 moves in an upward direction along the supply tube 80 of the closure body 56, and the previously disengaged seals 98 of the valve 58 move upward into engagement with the seats 99 of the closure body 56. Specifically, as depicted in FIG. 22, the first seal ridge 101 of the valve 58 engages the first seat 111 of the closure body 56 when the valve 58 is opened, and similarly shown in FIG. 23, the second seal ridge 102 engages the second valve seat 112. As noted above, this configuration of the seals 98 and seats 99 reduces stress in the closure assembly, which in turn improves the performance and reliability of the shut-off valve 56.

Any air leaks in the fluid dispensing system 47 can interfere with dilution. As fluid is drawn out of the container 41, a vacuum will form. Left unaddressed, this vacuum will severely distort the container 41 so as to introduce cracks in the sidewall of the container 41, which in turn can create subsequent air leakage. The closure assembly 43 according to the present invention is provided with the vent valve 61 that prevents the movement of liquid to the exterior of the system 47 but allows atmospheric pressure into the container to replace the withdrawn fluid.

Figure 24:
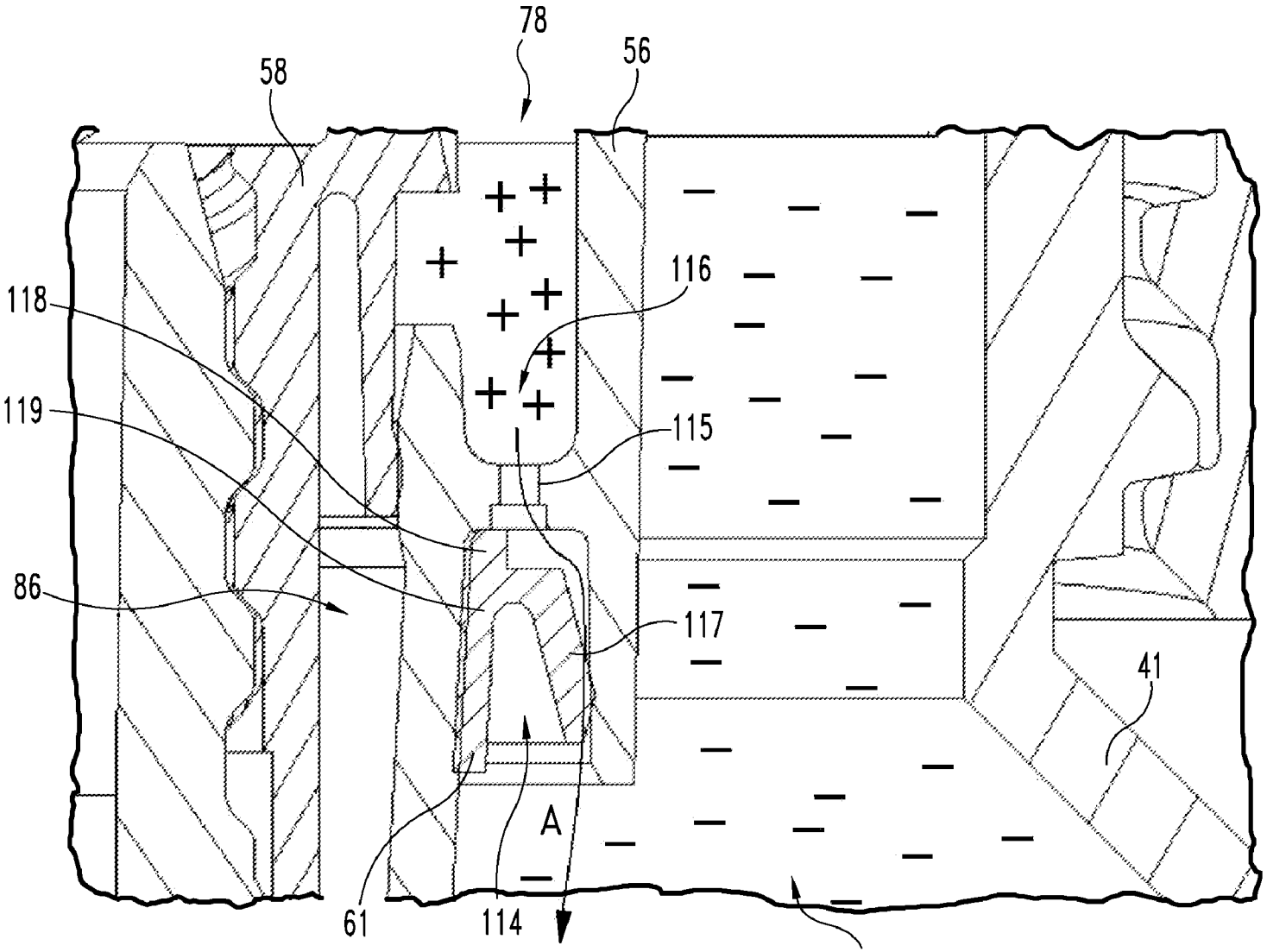
FIG. 24 is a cross sectional view of a venting structure of the FIG. 2 closure assembly.

As depicted in FIG. 24, the closure assembly 43 includes the vent valve 61 that relieves the low pressure in the container 41. On the container facing side 79, the closure body 56 defines a vent valve receptacle 114 in which the vent valve 61 is received. The vent receptacle 114 in the illustrated embodiment is ring-shaped and is positioned around the shut-off valve receptacle 86 in the closure body 56. One or more vent holes 115 are defined in the closure body 56 that communicate air from the cap facing side 78 to the vent receptacle 114. As shown, the vent holes 115 open into a vent slot 116 that is defined in the closure body 56 around the valve receptacle 86. The vent valve 61 according to the illustrated embodiment has a generally frustoconical shape. The vent valve 61 includes an angled flap 117 and one or more standoffs 118 that extend from a valve body 119. The standoffs 118 create a gap that allows air to flow from the vent holes 115. The flap 117 extends at an acute angle from the valve body 119 so that when the container 41 is negatively pressurized, the flap 117 is able to deflect in a radially inward direction, thereby allowing the ambient air to flow into the container 41 and equalize the pressure.

With reference to FIGS. 4 and 13, the closure body 56 further includes a container seal retainer 120 that is adapted to hold and orient the container seal 60 over the rim 50 of the container 41. In the illustrated embodiment, the container seal retainer 120 is a ring-shaped member that extends from the container facing side 79 and includes a lip 121 that engages the container seal 60. Once the closure assembly 43 is tightened onto the container 41, the container seal 60 forms a seal between the closure body 56 and the rim 50 of the container 41.

Figure 25:
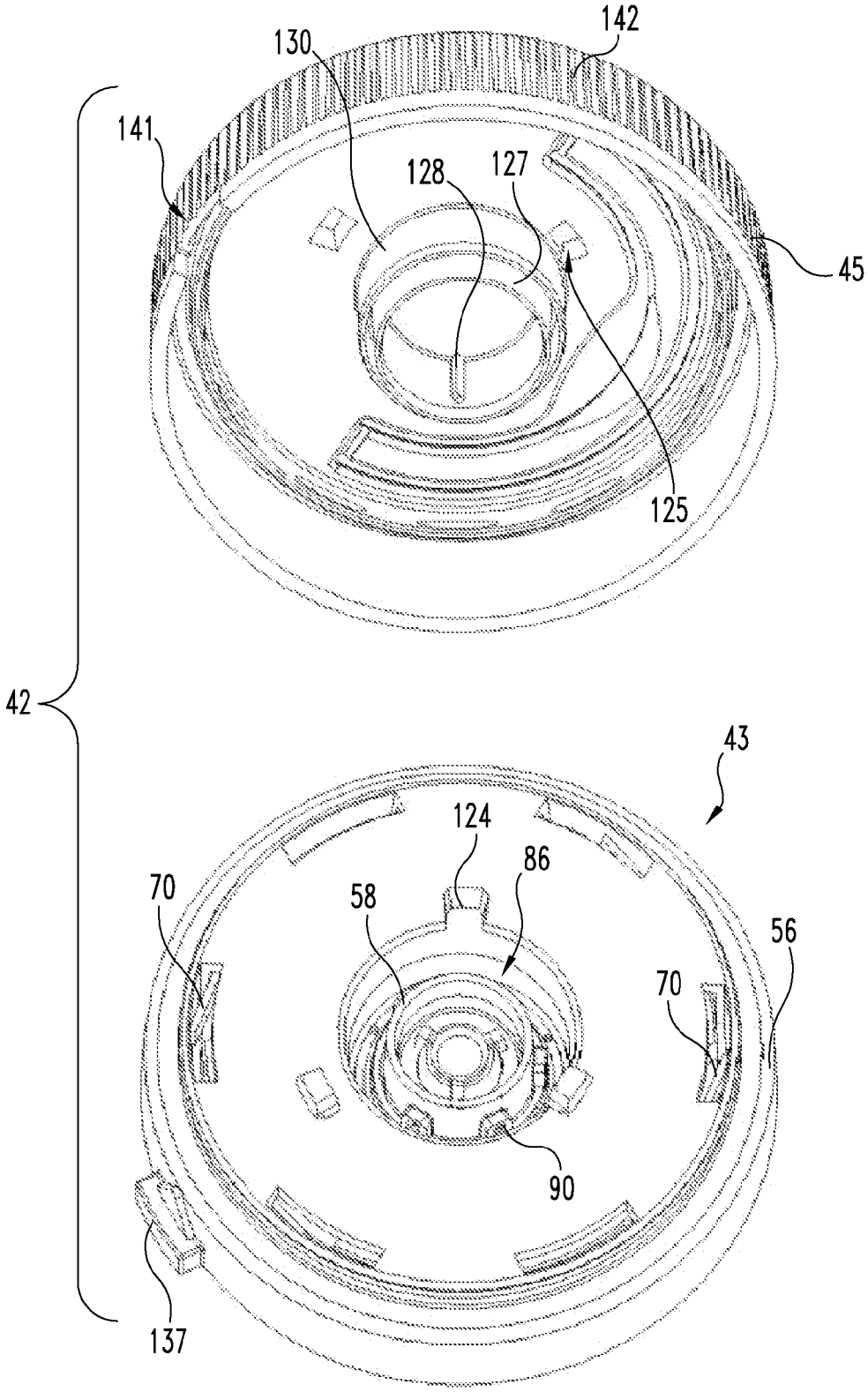
FIG. 25 is a second exploded view of the FIG. 2 transit cap and closure assembly.

The closure body 56 is configured to secure both the transit cap 45 and the cap assembly 46. To accomplish this, the closure body 56 has one or more cap engagement hooks 124 that extend from the cap facing side 78 in order to engage the transit cap 45 or the cap assembly 46. As depicted in FIG. 25, the hooks 124 are radially positioned around the shut-off valve receptacle 86 and are aligned to engage hook openings 125 that are formed in the transit cap 45. Once the hooks 124 are secured in the hook openings 125, as is shown in FIG. 3, the transit cap 45 is firmly secured to the closure assembly 43. Referring again to FIG. 25, the transit cap 45 has a valve engagement member 127 with a key engagement member 128 that is received in the valve receptacle 86. In the illustrated embodiment, the valve engagement member 127 has a generally cylindrical shape. The key engagement member or rib 128 is configured to engage one of the key members 90 on the shut-off valve 58 so that once the transit cap 45 is secured, the shut-off valve 58 is unable to rotate. By preventing the shut-off valve 58 from rotating, the key engagement member 128 prevents the shut-off valve 58 from rotating and being accidentally opened during transit or storage.

Figure 26:
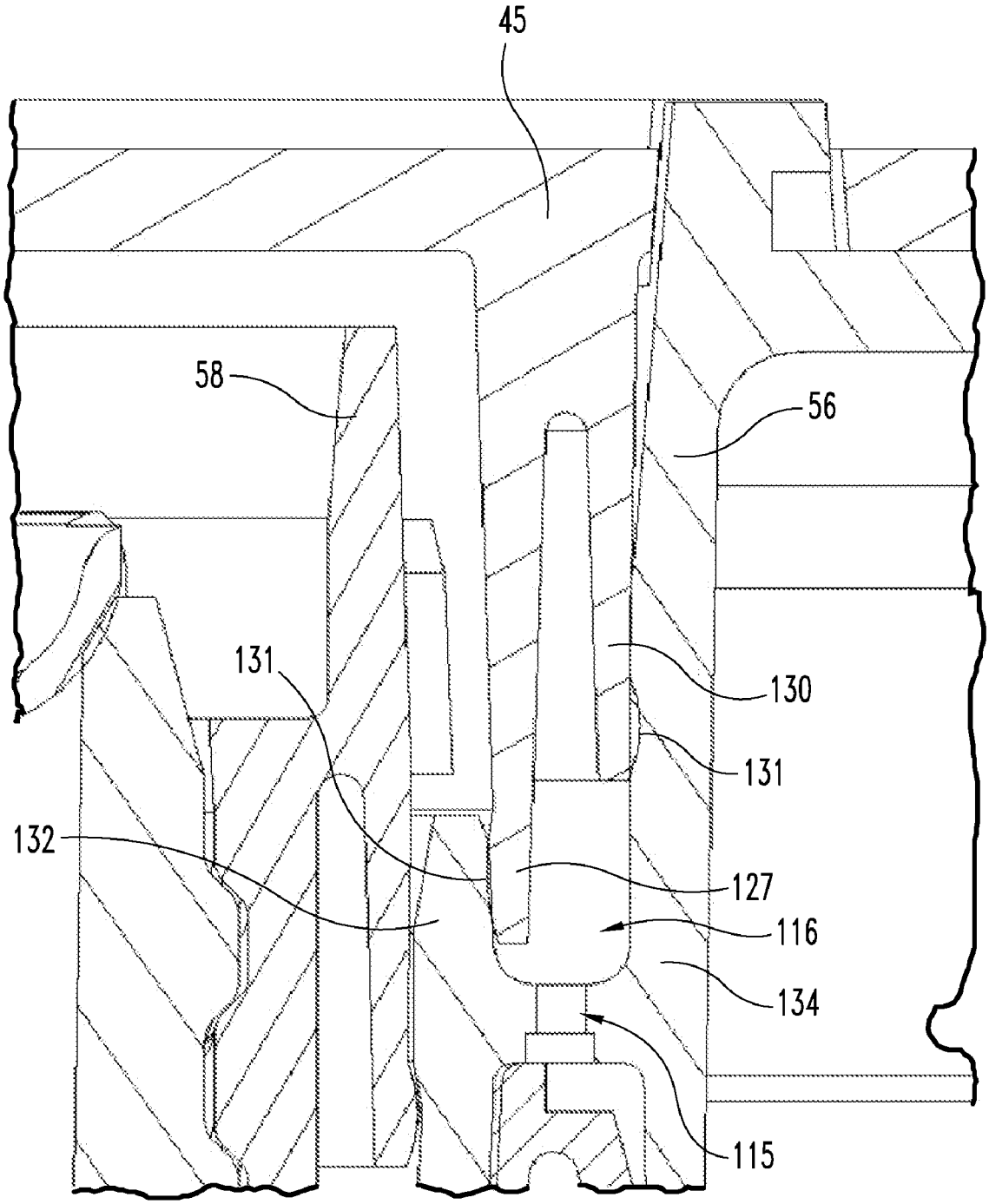
FIG. 26 is a cross sectional view, in full section, of the transit cap and closure body sealing interface of the FIG. 1 shipping assembly

To further minimize leakage during transit and storage, the transit cap 45 has an outer seal member 130 that surrounds the valve engagement member 127. Both members 127 and 130 in FIG. 26 have seal ridges 131 that are positioned to seal against the closure body 56. As shown, the seal ridge 131 of the valve engagement member 127 seals against an inner wall 132 of the vent slot 116, and the seal ridge 131 of the outer seal member 130 seals against an outer wall 134 of the vent slot 116 in the closure body 56. Seal ridges 131 serve to contain any weeping from the interior of the container 41 through the vent holes 115 and/or shut-off valve 58 during shipping or storage.

A closure indicator 137 extends from the outer periphery of the closure member 56. As will be described in greater detail below with reference to FIGS. 6 and 7, the closure indicator 137 in conjunction with a cap alignment indicator 139 on the cap assembly 46 are used to indicate whether the shut-off valve 58 is opened or closed. Both indicators 137, 139 in the illustrated embodiment have arrow-shaped portions, or some other type of visual cue, that point to one another when the valve 58 is closed. As illustrated in FIGS. 2 and 3, the transit cap 45 has an indicator notch 141 positioned to receive the closure indicator 137 when the transit cap 45 is secured to the closure assembly 43. The interface between the notch 141 and the closure indicator 137 as well as the hooks 124 and the hook openings 125 allows the transit cap 45 rotate about the closure assembly 43. The interlock between the notch 141 and indicator 137 allows for the transfer of capping torque from the transit cap 45 to the closure body 43 and ultimately to the container engagement member 54. When the transit cap 45 and the closure assembly 43 are mated together, the transit cap 45 can be rotated to secure and tighten the closure assembly 43 onto the container 41. To aid in securing the closure assembly 43 onto the container 41, the transit cap 45 has a textured gripping surface 142 around the periphery of the transit cap 45. In the illustrated embodiment, the gripping surface 142 is textured with serrations, but it is contemplated that in other embodiments the gripping surface 142 can be textured in other manners. To aid in removing the transit cap 45 before the cap assembly 46 is installed, a flexible handle or bail 144 is formed in the transit cap 45. The bail 144 can be bent away from the transit cap 45 and pulled in order to remove the transit cap 45 from the closure assembly 43.

Figure 27:
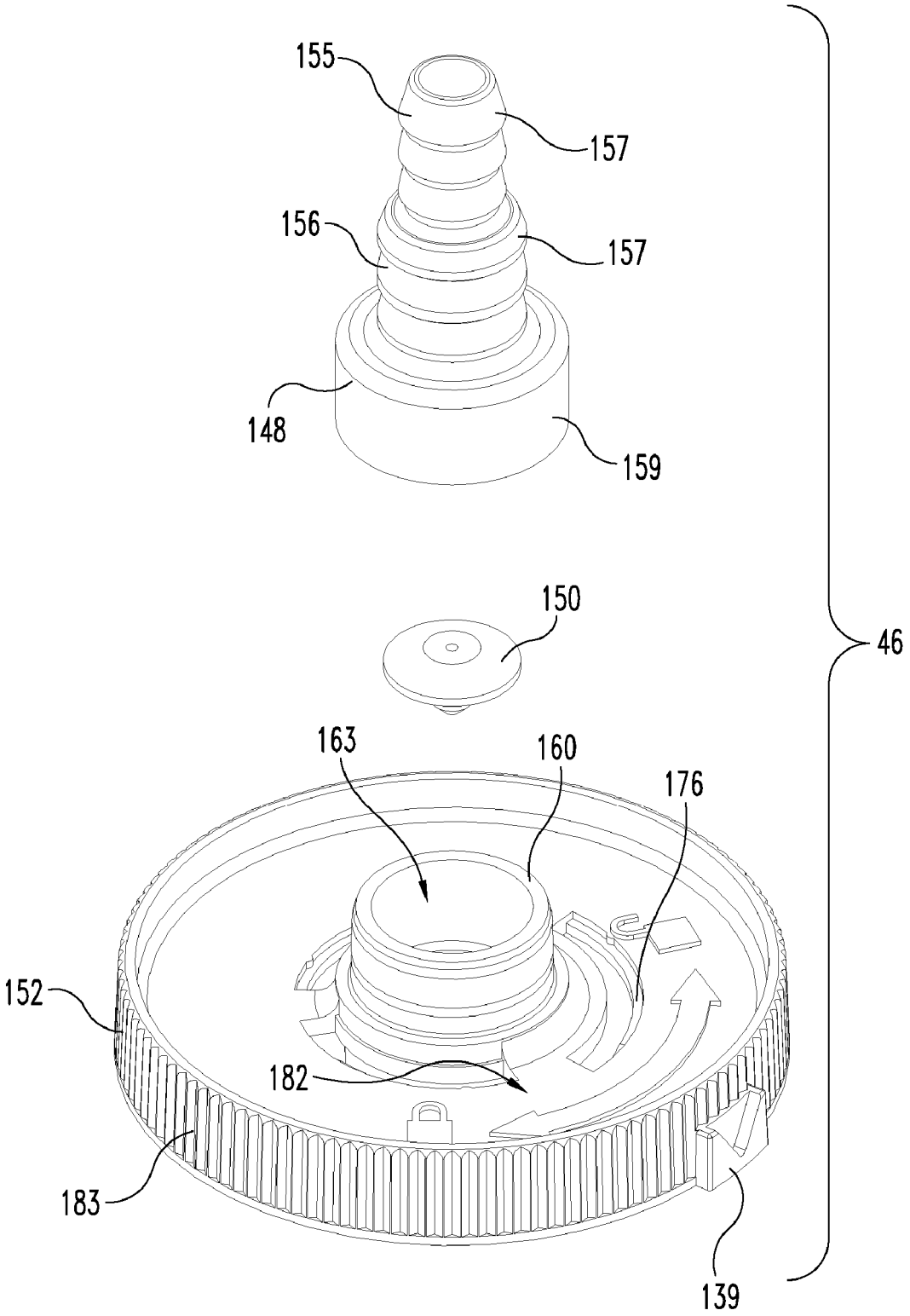
FIG. 27 is an exploded view of a cap assembly, which is a component of the FIG. 5 fluid dispensing system.

After the transit cap 45 is removed, the cap assembly 46 can be installed onto closure assembly 43, which is illustrated in FIG. 5, so as to permit the dispensing of fluid from the container 41. Referring to FIG. 27, the cap assembly includes a connector 148, a cap valve 150 and a cap base 152. The connector 148 is constructed and arranged to secure tubing from a proportioner or some other type of dispensing device to the cap assembly 46. In the illustrated embodiment, the connector 148 includes a first connection portion 155 and a second connection portion 156 that is larger than the first connection portion 155. By being sized differently, connection portions 155 and 156 are able to connect to two different sized tubing. Both connection portions 155, 156 have tube engagement ridges 157 that are configured to create a sealed connection with the tubing. The connector 148 further has a base coupling member 159 that is configured to engage a connector coupling member 160 on the cap base 152. The cap valve 150 acts as a check valve to minimize fluid leakage from the proprotioner delivery tubing as well as the cap assembly 46 when the cap assembly 46 is disconnected from the closure assembly 43. During container changeover, the cap assembly 46 must be disconnected from the closure assembly 43 and any concentrate residing in the delivery tubing of the proportioner must not leak. The cap valve 150 prevents the chemical in the tubing from leaking out resulting in potential physical damage to the surroundings, creation of a HAZMAT situation, or placing personnel at risk. In the illustrated embodiment, the cap valve 150 is an umbrella-type valve. However, it should be appreciated that other types of valves can be used.

Figure 29:
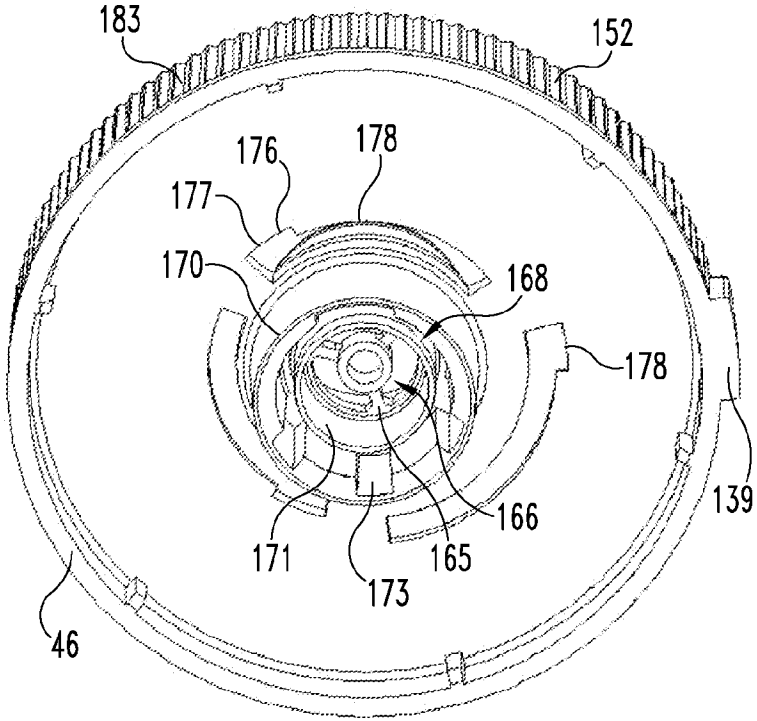
FIG. 29 is a perspective view of the FIG. 27 cap assembly.
Figure 28:
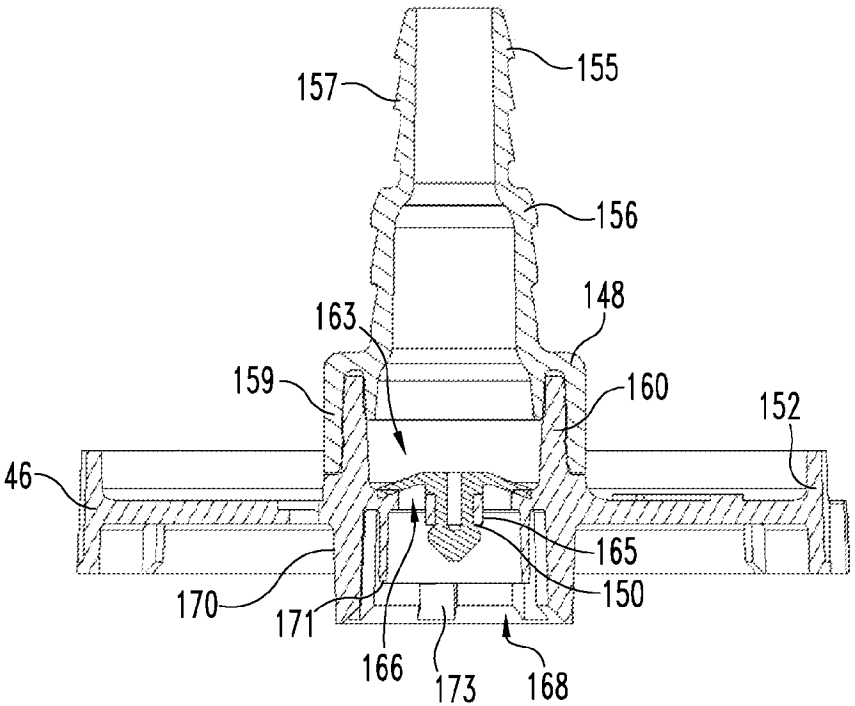
FIG. 28 is a cross sectional view, in full section, of the FIG. 27 cap assembly.
Figure 30:
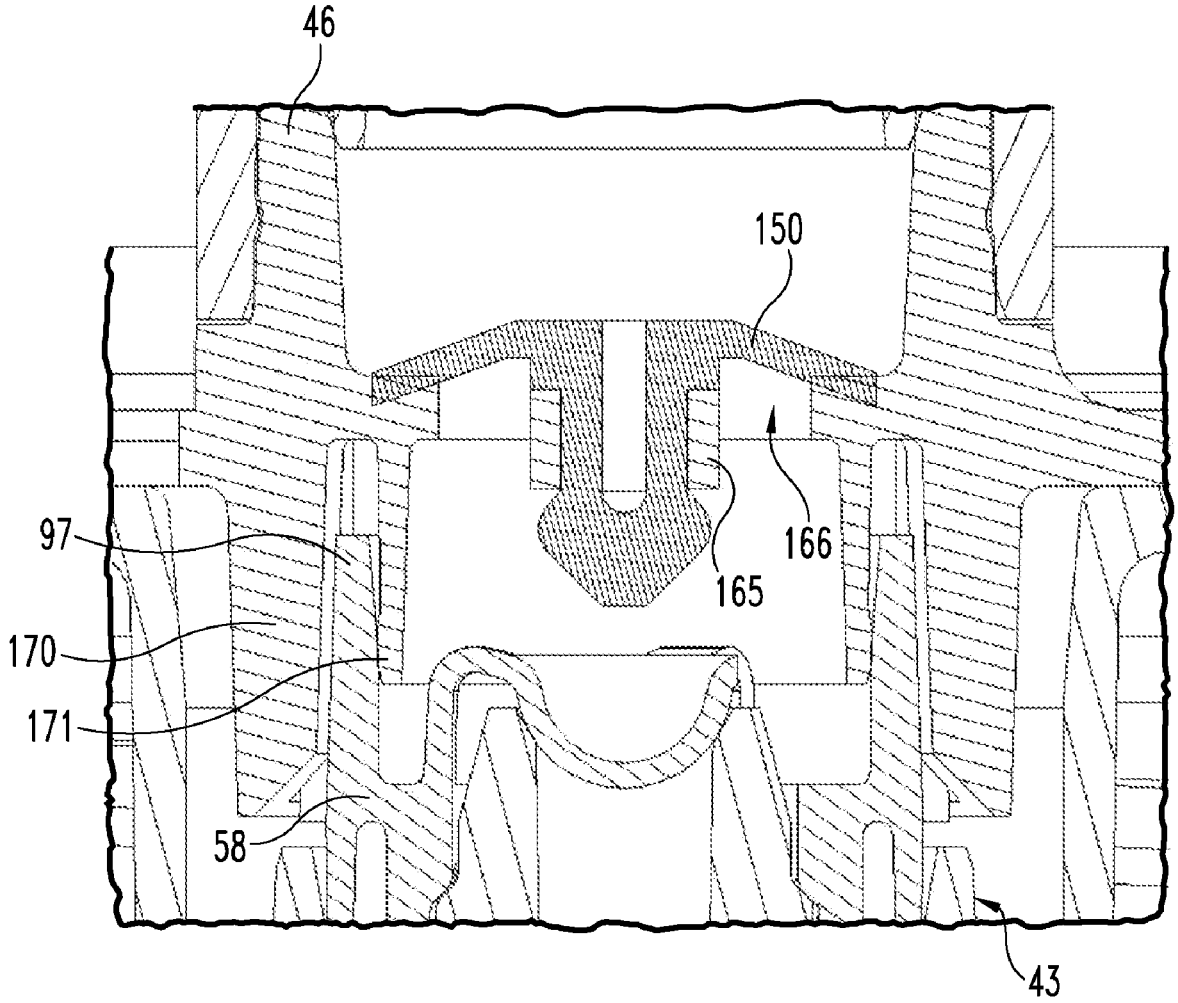
FIG. 30 is an enlarged, cross sectional view of the interface between the FIG. 27 cap assembly and the FIG. 2 closure assembly.

As illustrated in FIG. 28, the cap valve 150 is received inside a valve cavity 163 in the cap base 152. Within the valve cavity 163, the base 152 has a valve support 165 to which the cap valve 150 is secured. The valve support 165 defines one or more flow openings 166 through which the fluid can flow. The cap base 152 further includes a shut-off valve connector 168 that is configured to form a sealed connection with the shut-off valve 58. Valve connector 168 includes an outer connector member or ring 170 and an inner connector member or ring 171 that is positioned inside the outer connector ring 170. As shown in FIG. 29, the outer connector ring 170 has one or more keyway notches 173 that are sized, shaped, and oriented to mate with the key members 90 on the shut-off valve 58. As previously noted, to ensure that the correct cap assembly 46 for the chemical in the container 41 is secured, the key members 90 in one embodiment are uniquely sized, shaped, and/or oriented such that cap assemblies for other types of proportioners cannot be secured to the closure assembly 43. The inner connector ring 171 is constructed and arranged to engage and form a seal with the cap connection cup 97. With reference to FIG. 30, when the cap assembly 46 is connected to the closure assembly 43, the keys 90 are aligned with and slid into the keyways 173. The cap connection cup 97 of the shut-off valve 58 is slid between the outer ring 170 and the inner ring 171 of the cap assembly 46. As shown, once connected, the inner ring 171 seals against the cap connection cup 97, thereby minimizing fluid/air leakage between the closure assembly 43 and the cap assembly 46 when the shut-off valve 58 is opened.

Referring to FIG. 29, bayonet slots 176 are formed in the cap base 152 to receive hooks 124. Each bayonet slot 176 includes a hook opening 177 in which the hook 124 is inserted and a hook guide slot 178 that guides the rotation of the cap assembly 46. In the illustrated embodiment, the cap base 152 features three bayonet slots 176, one of which is out of position relative to the other two. The arrangement of the bayonet slots 176 matches the three hooks 124 that protrude from the cap facing side 78 of the closure assembly 43 and prevents cap-to-closure assembly until all components are properly aligned. This alignment is significant because the keyway notches 173 must align with the keys 90 on the shut-off valve 58. As shown in FIG. 27, the cap base 152 according to one embodiment includes instruction symbols 182 that provide instructions on how to open and close the shut-off valve 58. The outer periphery of the cap base 152 includes a gripping surface 183 for the end user. In the illustrated embodiment, the gripping surface 183 includes a plurality of serrations.

To attach the cap assembly 46, as shown in FIG. 6, the cap assembly 46 is oriented such that the closure 137 and cap 139 indicators are aligned, and the hooks 124 are inserted through the hook openings 177 in the bayonet slots 176. When the cap assembly 46 is initially attached, the shut-off valve 58 is closed. In order to open the shut-off valve 58 in the illustrated embodiment, the cap assembly 46 is rotated in a clockwise direction, as is illustrated in FIG. 7, and the fluid can be dispensed from the container 41. The shut-off valve 58 can be again closed by rotating the cap assembly 46 in a counter clockwise manner. Once in the closed position (FIG. 6), the cap assembly 46 can be removed from the closure assembly 43. The cap assembly 46 is designed to be reused in contrast to the closure assembly, which remains with the container 41 when discarded. As noted above, the cap valve 150 in the cap assembly 46 prevents fluid from back flushing from the cap assembly, thereby preventing the fluid from being spilled accidentally.

Proportioners are capable of certain mix ratios when operated without metering orifices in the chemical delivery path. These ratios will be unique to the type of proportioner employed. Understanding these ratios assists field service technicians as they select and install metering orifices appropriate for a target chemical concentrate. Accordingly, the fluid dispensing system 47 of the present invention is designed not to restrict the flow rate. If the flow rate were restricted, the net result would be a leaner mix with resulting poorer product performance. The addition of fluid dispensing system 47 according to the present invention minimizes the impact on the performance of an unrestricted proportioner. The fluid paths in the fluid dispensing system 47 of the present invention are sized to minimize the impact upon unrestricted proportioners.

After the fluid, such as a concentrate, is filled into the container 41 at the plant of the supplier, the container 41 is fitted with the closure assembly 43. At initial hook-up or container changeover, the transit cap 45 is removed from the closure assembly 43. The container 41 with closure assembly 43 is positioned appropriately relative to the proportioner and the cap assembly 46 is brought into contact with the closure assembly 43. As depicted in FIGS. 6 and 7, the indicators 137, 139 on both the closure body 56 and the cap base 152 provide a visual cue for alignment. The placement of the closure body hooks 124 and cap bayonet slots 176 provide tactile feedback for alignment. The height of the hooks prevents the keys 90 from engaging before proper alignment has been achieved. When alignment is achieved, the cap assembly 46 can be pushed down upon the closure assembly 43. This movement engages the keys 90 and seal between the cap assembly 46 and shut-off valve 58. In the illustrated embodiment, a clock-wise turn of the cap assembly 46 opens the shut-off valve 58. As discussed above, this is the reason a left-hand thread is required in the shut-off valve 58. In one embodiment, detent features are placed at the ends of the bayonet slots 176 to inform the end user that the valve 58 is completely open and ready for use. When the shut-off valve 58 is completely open, all seals are engaged to prevent the introduction of air into the fluid dispensing system 47 as concentrate is drawn into the proportioner.

Disconnection simply requires turning the cap assembly 46 fully counter clock-wise realigning the indicators 137, 139, which ultimately closes the shut-off valve 58. The cap assembly 46 is then pulled free from the closure assembly 43. Only a minimal amount of concentrate may remain at the connection interface in the closure assembly 43. The remaining concentrate in the proportioner tube is prevented from pouring out by the cap valve 150. At this point, the connection technique can begin again.

A container engagement member or threaded collar 190, according to another embodiment, with additional anti-removal or anti-circumvention features will now be described with reference to FIGS. 31, 32, and 33. As should be apparent, the collar 190 is designed to be incorporated into the closure system 42 described above as well in other embodiments of the closure system 42. The collar 190 in FIG. 31 share a number of features in common with the FIG. 9 (and FIG. 9A) container engagement member 42. For example, like the FIG. 9 container engagement member 42, the collar 190 in FIG. 31 has the central opening 63, the inner radial wall 64, the outer radial wall 65, the threading 67, the groove 68, fingers 70, and deflection notches 71 along with other common features. Similar to the previous embodiment, the collar 190 is ring-shaped, and the collar 190 is configured to rotate independently of the closure body 56 in one direction so that the closure assembly 43 can be easily secured to the container 41 but cannot be easily removed. For the sake of clarity as well as brevity, the common features will not again be discussed in great detail below, but reference is made to the previous discussion of these features.

As mentioned before, it is desirable that the closure for the containers be very difficult to remove once installed. Due to geometries involved with traditional closures, it is difficult to manufacture a closure with structures that prevent removal of the cap or closure from the container. For instance, with traditional plastic molding, anti-removal structures formed on the enclosure tend to make removal or stripping of the closure during ejection from the molds difficult, if not practically impossible. Since the collar 190 is manufactured separately from the closure body 56, it is then possible to add additional anti-removal features, such as to the threading 67. As an illustration, due to its ring shape, the collar 190 when injection molded does not need to be unscrewed or stripped in some other manner during ejection from the mold. Looking at FIG. 33, the threading or thread 67 extends in a generally helical manner around the central opening for about 360°. Anti-removal details to the threading 67 can be formed with normal open-close movement of the opposing core pins that form the central opening 63 in the collar 190. The outer periphery of the shut-off or end faces of the opposing core pins are machined in a manner so as to form the threading 67 of the collar 190. The witness lines created at the interface between the collar pins are located along the crest of the threading 67.

Again, the design of the collar 190 and the above-described tooling configuration allows for the introduction of features not normally possible in threaded components. For example, the teeth 77 of the FIG. 9A container engagement member 54*a*, which are configured to bite into the major diameter of the container 41, are possible with such a tooling configuration. As will be described below, other features are also possible.

Figure 31:
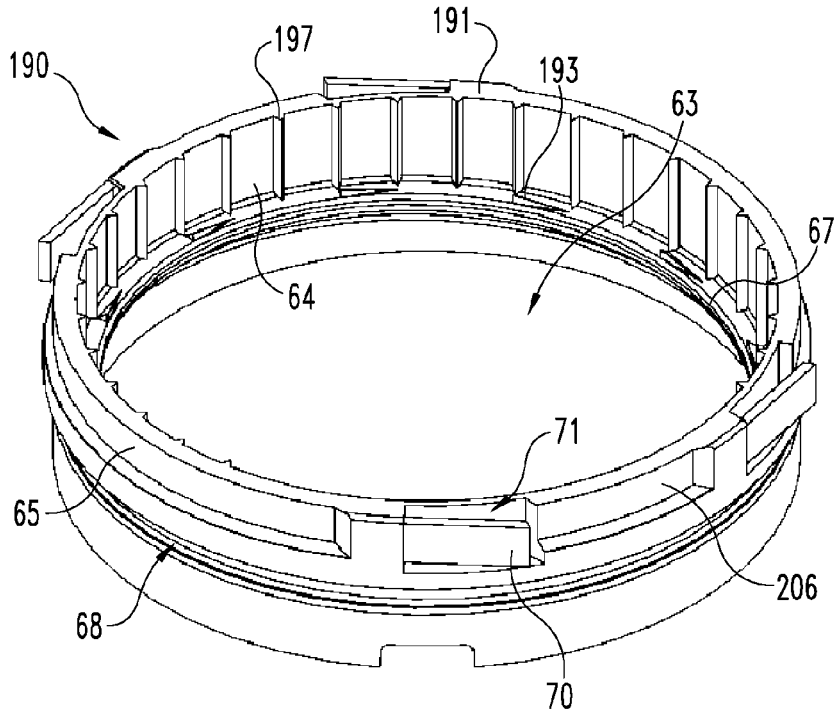
FIG. 31 is a first, top perspective view of a container engagement member or collar according to another embodiment.
Figure 32:
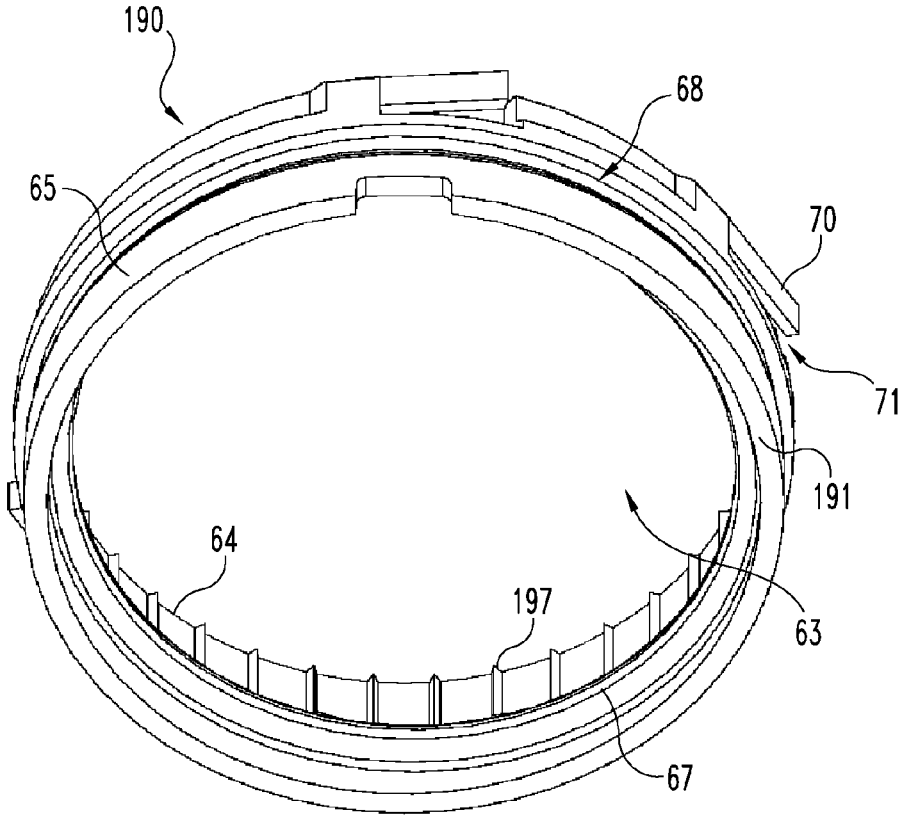
FIG. 32 is a bottom perspective view of the FIG. 31 container engagement member.
Figure 34:
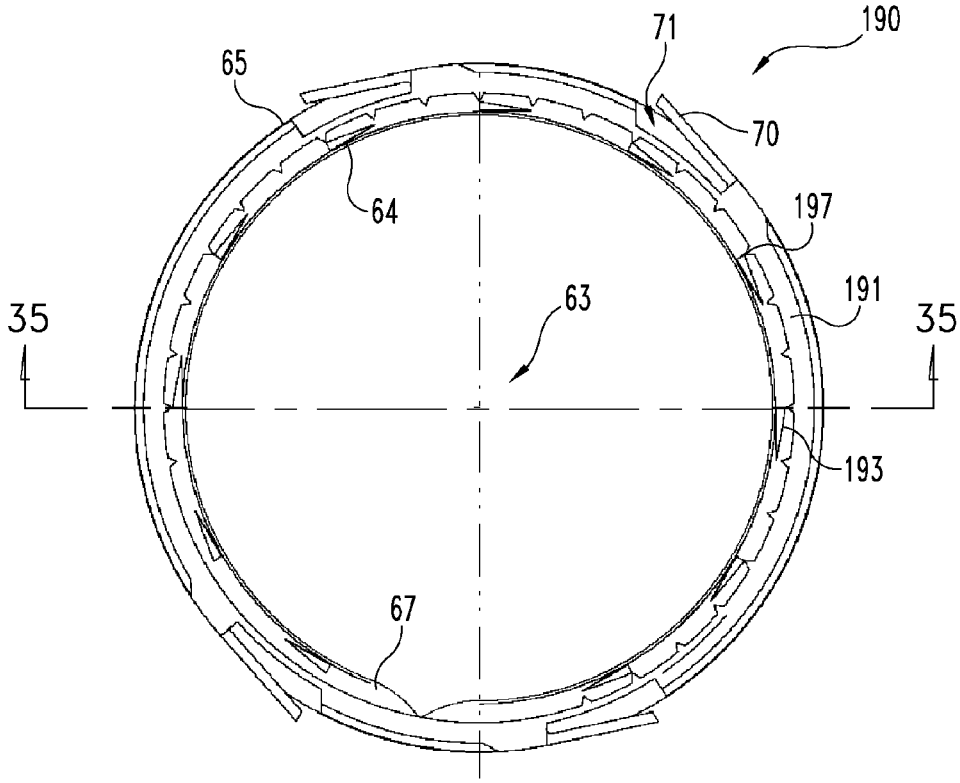
FIG. 34 is a top view of the FIG. 31 container engagement member.
Figure 35:
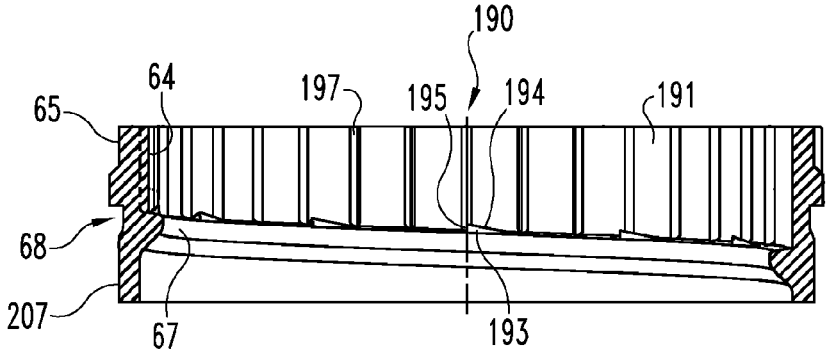
FIG. 35 is a cross-sectional view of the FIG. 31 container engagement member as taken along line 35-35 in FIG. 34.

With reference to FIGS. 31, 34, and 35, the collar 190 has a collar body 191 with internal threading 67. The threading 67 has one or more thrust teeth 193 that are configured to prevent unscrewing of the closure assembly 43. Looking at FIG. 35, each thrust tooth 193 incorporates an angled, ramp portion 194 that tapers in a manner to permit screwing of the closure assembly 43 onto the container 41. Each thrust tooth 193 further incorporates a retention surface 195 that extends generally perpendicular to the threading 67 for preventing unscrewing of the closure assembly 43. As can be seen, the thrust teeth 193 extend from the surface of the threading 67 in an upward direction relative to the opening 51 of the container 41 when the closure assembly 43 is secured.

The thrust teeth 193 provide little resistance during capping of the container 41, but the thrust teeth 193 provide significant resistance if a person tries to remove the closure assembly 43. In an attempt to remove the closure assembly 43 from the container 41, a user may try to pull the closure assembly 43 away from the container 41 while attempting to unscrew the closure assembly 43. However, as the user pulls on the closure assembly 43, the teeth 193 bite into the thrust surface of the container threading 48 (FIG. 1). As greater pulling force is applied, the thrust teeth 193 bite even further into the threading 48 of the container 41, thereby creating ever greater resistance to unscrewing of the closure assembly 43. In addition, when the container 41 is made of a softer material, such as a soft plastic, cold flow of the container material can occur from the closure assembly 43 being torqued into place. The cold flow of the container material creates a pocket for each tooth 193, which in turn makes removal of the closure assembly 43 even more difficult.

As illustrated in FIG. 35, the collar body 191 further includes one or more vertical container engagement teeth 197 that are constructed to prevent unscrewing of the closure assembly 43 when tightly gripped. While attempting to unscrew the closure assembly 43, a person may tightly squeeze the outer periphery of the closure body 56 so as to create a frictional engagement between the closure body 56 and the collar 190, which would allow the person to unscrew the collar 190 from the container 41. Upon squeezing of the closure body 56, the container engagement teeth 197 dig into the container 41, thereby preventing any unscrewing motion of the closure assembly 43.

In the illustrated embodiment, the container engagement teeth 197 extend in a vertical direction along the inner radial wall 64 of the collar body 191. With the container engagement teeth 197 extending vertically, the collar 190 can be easily removed from a mold during manufacturing. The container engagement teeth 197 in the depicted embodiment are generally spaced apart in an even manner and are positioned above the thread 67, when attached to the container 41. It nevertheless should be recognized that the container engagement teeth 197 can be shaped differently, spaced apart differently, and/or located elsewhere on the collar 190 in other embodiments. Moreover, the container engagement teeth 197 do not need to be positioned all the way around the collar 190, as is depicted in FIG. 33, but if so desired, the container engagement teeth 197 can be disposed completely around the collar 190. If someone tries to remove the closure assembly 43 by tightly squeezing the closure assembly 43 in order to deform it, the container engagement teeth 197 will bite into the container threading 48 of the container 41, thereby preventing the closure assembly 43 from being unscrewed. The more the closure assembly 43 is squeezed, the greater the biting force is applied by the container engagement teeth 197, which in turn further resists twisting of the collar 190.

Figure 33:
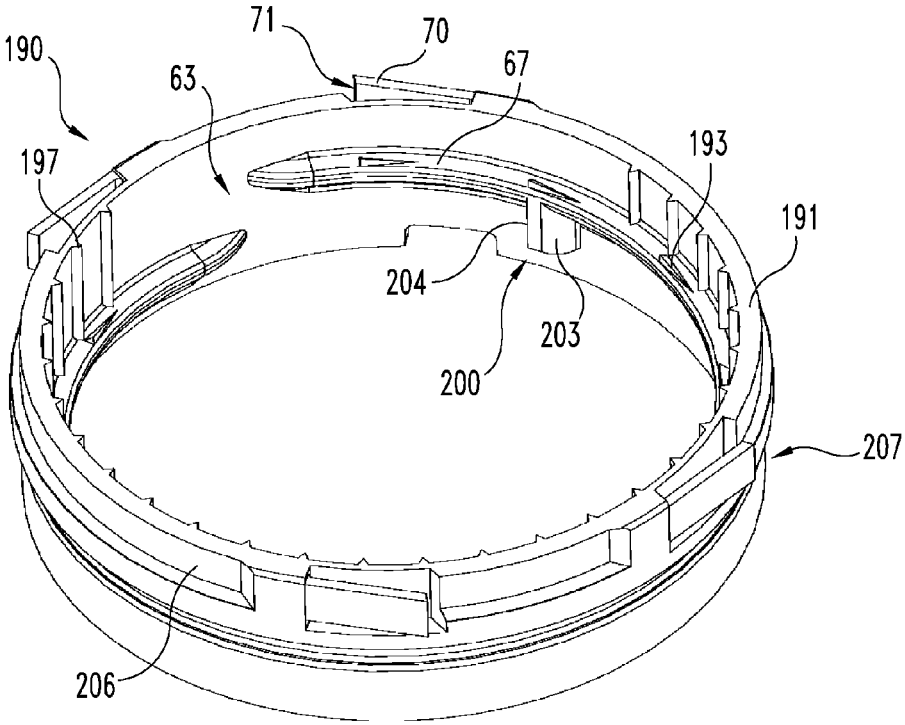
FIG. 33 is a second, top perspective view of the FIG. 31 container engagement member.
Figure 36:
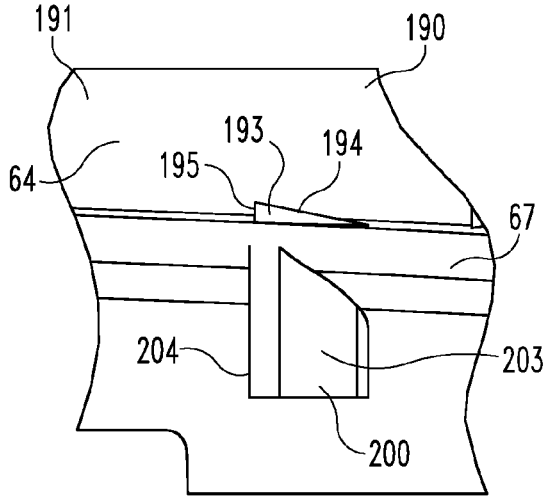
FIG. 36 is an enlarged view of a blocking tooth disposed on the FIG. 31 container engagement member.
Figure 37:
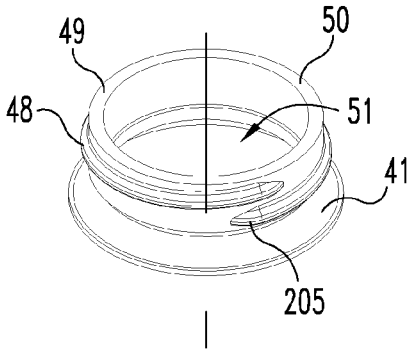
FIG. 37 is a partial perspective view of a container to which the FIG. 31 container engagement member is secured.

Turning to FIG. 33, the collar body 191 further includes a blocking tooth 200 that prevents unscrewing of the closure assembly 43 once properly secured to the container 41. In the depicted embodiment, only one blocking tooth is shown, but it is contemplated that the collar 190 can include more than one blocking tooth 200. As can be seen in FIG. 36, the blocking tooth 200 includes an angled ramp surface 203 and a thread anchor or biting edge 204. The ramp surface 203 permits the collar 190 to be threaded onto the container 41 with minimal drag. On the other hand, the anchoring edge 204 extends generally perpendicular to the inner wall 64 of the collar 190 so as to bite into the thread of the container 41 if someone attempts to unscrew the closure assembly 43. Looking at both FIGS. 36 and 37, the blocking tooth 200 is positioned on the collar 190 such that when the collar is properly secured or torqued onto the container 41, the blocking tooth 200 is positioned past a tail end 205 of the thread 48 on the container 41. If a person is somehow able to turn the collar in the unscrewing direction, the sharp anchor edge 204 of the blocking tooth 200 bites into the tail end 205 of thread 48 on the container 41, thereby preventing unscrewing of the closure assembly 43. A person might try squeezing the closure assembly 43 to deform the collar 190 into the shape of an oval or other shape so as to disengage the blocking tooth 200 from the tail end 205 of the thread 48. However, when the blocking tooth 200 is used in conjunction with the container engagement teeth 197, this situation is prevented. Once the closure assembly 43 is squeezed, the container engagement teeth 197 bite into the container 41, thereby preventing rotation of the closure assembly 43.

In order to further combat tampering as well as minimize manufacturing costs, the collar 190 includes one or more friction reduction notches or sections 206, as is depicted in FIG. 31. The notches 206 reduce the surface contact area between the collar 190 and the closure body 56 such that the overall frictional force that can be applied by the closure body 56 to the collar 190 is reduced. This in turn makes removal of the closure assembly 43 even more difficult. The notches 206 also reduce the requisite material needed to make the collar 190. Further, the collar 190 in FIG. 35 has a friction reduction section or portion 207 that has a wall thickness that is generally smaller than the rest of the collar 190 such that the outer diameter of the collar 190 at section 207 is generally smaller than the rest of the collar 190. In one embodiment, the wall thickness of the collar 190 at the notches 206 and section 207 is generally the same, but in other embodiments, the wall thicknesses can be different. In the illustrated embodiment, the reduced wall thickness of the friction reduction section 207 extends continuously around the entire circumference of the collar 190, but it is envisioned that in other embodiments section 207 can be discontinuous so as to create individual friction reduction notches 206. In a fashion similar to the friction reduction notches 206, the smaller outer diameter of section 207 reduces the surface contact area between the collar 190 and the closure body 56 such that the overall frictional force that can be applied by the closure body 56 to the collar 190 is reduced. Furthermore, the reduced wall thickness at section 207 reduces the requisite material needed to manufacture the collar 190.

As should be appreciated, the above-discussed anti-circumvention features help to prevent or make very difficult the removal of the closure assembly 43 when force is applied in various directions, especially by hand. For example, the thrust teeth 193 prevent unscrewing of the closure assembly 43 when a vertical force is applied, and the container engagement teeth 197 prevent unscrewing of the closure assembly 43 when a clamping or radially inward force is applied. The blocking tooth 200 prevents unscrewing of the closure assembly 43 when a rotational force is applied. It is envisioned that any combination of the various above-mentioned features that prevent unscrewing of the closure assembly 43 can be combined together. For example, the blocking tooth can be optional in several embodiments. In one particular embodiment, the collar 190 has the thrust teeth 193 and the container engagement teeth 197, but the collar 190 does not have the blocking tooth 200.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

What is claimed is:

1. A fluid dispensing system, comprising:

a closure assembly constructed and arranged to enclose a container, the closure assembly including a shut-off valve constructed and arranged to close upon rotating the shut-off valve in a first direction and to open upon rotating the shut-off valve in a second direction, a container engagement collar having an internal thread engageable with threading on the container, a closure body to which the collar is coupled in a ratcheting manner, wherein the closure body includes one or more tabs each having a notch, and the collar having a groove engaging the tabs and one or more fingers that are configured to engage the notches in the ratcheting manner in which the container engagement collar is only able to rotate in one direction relative to the closure body to increase the difficulty in removing the closure assembly from the container.

2. The system of claim 1, wherein the thread of the collar has one or more thrust teeth located to bite into the threading of the container upon pulling of the closure assembly away from the container in an attempt to unscrew the closure assembly.

3. The system of claim 1, wherein the collar has one or more container engagement teeth extending radially inwards to bite into the threading of the container upon squeezing of the closure assembly.

4. The system of claim 1, wherein the collar includes a blocking tooth positioned to engage a tail end of the threading on the container upon an attempt to unscrew the closure assembly.

5. The system of claim 4, wherein the collar has one or more container engagement teeth extending radially inwards to bite into the threading of the container upon squeezing of the closure assembly in an attempt to disengage the blocking tooth from the threading of the container.

6. The system of claim 5, wherein the thread of the collar has one or more thrust teeth extending therefrom.

7. The system of claim 1, comprising means for preventing removal of the closure assembly from the container.

8. The system of claim 7, wherein the means for preventing removal of the closure assembly includes one or more thrust teeth extending from the thread of the collar.

9. The system of claim 1, wherein the collar defines one or more friction reduction notches configured to reduce surface contact area between the collar and the closure body.

10. A container engagement collar, comprising:

a collar body having an internal thread engageable with threading of a container;

the collar body defining a groove in which one or more retention tabs of a closure body are slidably received to permit relative movement between the collar and the closure body; and the collar body having one or more fingers configured to engage notches in the closure body in a ratcheting manner, wherein the collar body includes one or more thrust teeth extending from the thread of the collar body.

11. The collar of claim 10, wherein the collar body includes one or more container engagement teeth extending radially inwards.

12. The collar of claim 11, wherein the collar body includes a blocking tooth positioned to engage a tail end of the threading on the container.

13. The collar of claim 10, wherein the collar body includes a blocking tooth positioned to engage a tail end of the threading on the container.

14. The collar of claim 10, wherein the collar body defines one or more friction reduction notches positioned to face the closure body to reduce frictional contact between the collar body and the closure body.

15. The collar of claim 10, wherein the collar body has a friction reduction section that has an outer diameter that is smaller than the rest of the collar body to reduce frictional contact between the collar body and the closure body.

16. A fluid dispensing system, comprising:

a closure assembly constructed and arranged to enclose a container, the closure assembly including a closure body having a fluid opening through which fluid is dispensed from a container, the closure body including one or more tabs and one or more notches, a shut-off valve rotatably coupled to the closure body, the shut-off valve being able to rotate relative to the closure body in a first direction and a second direction that is opposite the first direction, the shut-off valve being constructed and arranged to close the fluid opening of the closure body upon rotating the shut-off valve in the first direction and to open the fluid opening upon rotating the shut-off valve in the second direction, and a container engagement collar having a groove extending continuously around an outer radial wall of the container engagement collar, the container engagement collar being a separate component from the closure body, the tabs of the closure body being snapped into the groove of the container engagement collar to allow the collar engagement collar to rotate freely relative to the closure body, the container engagement collar having an internal threading engageable with threading on the container, and the container engagement collar having one or more tabs configured to engage the notches of the closure body in a ratcheting manner in which the tabs engage the notches when the closure body is rotated in a securing direction where the container engagement collar rotates with the closure body to secure the closure assembly to the container and the tabs disengage from the notches when the closure body is rotated in the opposite direction to the securing direction to allow the container engagement collar to remain secured to the threading of the container while the closure body rotates in the opposite direction relative to the container engagement collar.

17. The system of claim 16, wherein the collar has one or more container engagement teeth extending radially inwards to bite into the threading of the container upon squeezing of the closure assembly.

18. The system of claim 17, wherein the threading of the collar has one or more thrust teeth located to bite into the threading of the container upon pulling of the closure assembly away from the container in an attempt to unscrew the closure assembly.

19. The system of claim 18, wherein the collar includes a blocking tooth positioned to engage a tail end of the threading on the container upon an attempt to unscrew the closure assembly.

* * * * *